US005636009A

United States Patent [19]

Honda et al.

[11] Patent Number: 5,636,009

[45] Date of Patent: Jun. 3, 1997

[54] IMAGE FORMING APPARATUS HAVING CHARGING MEMBER

[75] Inventors: Takao Honda, Yokohama; Tsuyoshi Watanabe, Ebina; Tadashi Ishikawa, Tokyo; Masanori Muramatsu; Isamu Sato, both of Yokohama; Makoto Yanagida, Kawasaki; Fumihiro Arahira, Kanagawa-ken; Takeo Yamamoto, Yokohama, all of Japan

[73] Assignee: Canon Kabushiki Kaisha, Tokyo, Japan

[21] Appl. No.: 662,280

[22] Filed: Jun. 12, 1996

Related U.S. Application Data

[63] Continuation of Ser. No. 528,606, Sep. 15, 1995, abandoned, which is a continuation of Ser. No. 53,215, Apr. 28, 1993, abandoned.

[30] Foreign Application Priority Data

Apr. 28, 1992 [JP] Japan ..... 4-137743
Jul. 16, 1992 [JP] Japan ..... 4-213792

[51] Int. Cl.[6] ..... G03G 21/00

[52] U.S. Cl. ..... 399/50; 399/51; 399/176

[58] Field of Search ..... 355/203, 204, 355/208, 211, 212, 219, 228; 361/221, 225, 230

[56] References Cited

U.S. PATENT DOCUMENTS

| | | | |
|---|---|---|---|
| 3,935,517 | 1/1976 | O'Brien | 317/262 |
| 5,072,258 | 12/1991 | Harada | 355/208 |
| 5,144,368 | 9/1992 | Ohzeki et al. | 355/219 |
| 5,159,388 | 10/1992 | Yoshiyama et al. | 355/208 |
| 5,160,967 | 11/1992 | Tonegawa | 355/208 |
| 5,278,612 | 1/1994 | Inui | 355/211 X |

FOREIGN PATENT DOCUMENTS

| | | |
|---|---|---|
| 0338546 | 10/1989 | European Pat. Off. . |
| 0461656 | 12/1991 | European Pat. Off. . |
| 58-90652 | 5/1983 | Japan . |
| 58-136057 | 8/1983 | Japan . |
| 59-201075 | 11/1984 | Japan . |
| 61-138267 | 6/1986 | Japan . |
| 62-51492 | 3/1987 | Japan . |
| 62-230334 | 10/1987 | Japan . |

OTHER PUBLICATIONS

European Search Report.

*Primary Examiner*—William J. Royer
*Attorney, Agent, or Firm*—Fitzpatrick, Cella, Harper & Scinto

[57] ABSTRACT

An image forming apparatus includes a movable image bearing member, having a photosensitive layer; an image forming device for forming an image on the image bearing member: a charging member for charging the image bearing member; and a light radiating device for radiating light on the image bearing member; a detector for detecting a datum rotating to a thickness of the photosensitive layer on the basis of the voltage-current characteristic between the charging member and image bearing member; and a controller for controlling the amount of light radiated from the light radiating device to be increased with decrease in the thickness of the photosensitive layer, in response to the detector.

49 Claims, 23 Drawing Sheets

IMAGE FORMING APPARATUS HAVING CHARGING MEMBER

This application is a continuation-in-part of application No. 08/528,606, filed Sep. 15, 1995, now abandoned, which was a continuation of application No. 08/053,215 filed Apr. 28, 1993, now abandoned.

FIELD OF THE INVENTION AND RELATED ART

The present invention relates to an image forming apparatus, such as an electrophotographic apparatus (copying machine, optical printer, and the like) and an electrostatic recording apparatus, which forms an image by means of adopting an image forming process of the transfer type (indirect type) or direct type, comprising a process in which the surface of an image bearing member (sensitive material for electrophotographic recording, dielectric material for electrostatic recording, or the like) is treated to become chargeable.

More preferably, it relates to an image forming apparatus employing a charging apparatus of a contact type in which, as means for charging the material to be charged, a charging member imparted with a voltage is placed in contact with the material to be charged, so that the surface of the material to be charged is charged.

Further, it relates to an image forming apparatus which forms an image by means of employing an image forming process comprising a process in which an optical image reflecting the image data of an original image is formed on the charged surface of the material to be charged.

The contact type charging apparatus, which charges the surface of the material to be charged, by means of placing the charging member imparted with a voltage in contact with the surface of the material to be charged, allows the usage of a low voltage power source, having the advantage of generating a lesser amount of ozone or the like. Therefore, it has been attracting attention as an alternative charging means to the corona discharging apparatus, for example, which charges the surface of the image bearing member such as photosensitive material, dielectric material, or the like, and studies have been going on for its practical usage.

For instance, as has been proposed (Laid-Open Japanese Patent Application Nos. 51492/1987 and 230334/1987) by the applicant of the present invention, if an oscillating electric field (alternating electric field, electric field (voltage) in which the voltage value changes periodically) having more than twice the peak-to-peak voltage compared to the initial DC charge voltage applied to the charging member for charging the material to be charged is formed between the charging member and the material to be charged, and in addition, if a charging member having a high resistance layer as the surface layer is employed, it is possible to enhance the charge uniformity of the material to be charged, and to prevent leaks caused by a pin hole or damages on the surface of the material to be charged, such as photosensitive material.

There are some apparatuses in which the charge is directly applied to the surface of the material to be charged, by means of placing an electrically conductive member, as the charging member, (electrically conductive member capable of holding potential), such as electrically conductive fiber brush, electrically conductive elastic roller, or the like, in contact with the material to be charged, whereby the surface of the material to be charged is charged to a predetermined potential through the direct application of the charge.

FIG. 20 is cross-sectional view of an example of a contact type charging apparatus, depicting the essential structure thereof.

Reference numeral 1 designates a material to be charged. In this example, it is an electrophotographic sensitive material of a rotatable drum type (hereinafter, referred to as photosensitive material). The photosensitive material 1 in this example comprises basic structural layers, which are an electrically conductive base layer **1*b* made of material such as aluminum and a photoconductive layer 1*a* formed on the exterior surface of the base layer 1*b***.

Reference numeral 2 designates a charging member. In this case, it is of a roller type (hereinafter, referred to as charging roller). The charging roller 2 comprises a central metal core **2*c*, electrically conductive layer 2*b* formed on the peripheral surface of the metal core 2*c*, and a resistive layer 2*a* formed on the peripheral surface of the conductive layer 2*b***.

The charging roller 2 is rotatably supported by unshown bearing members, with each of the end portions of the metal core **2*c* resting in the bearing, and is disposed in parallel to the drum type photosensitive material 1 while being pressed by a predetermined contact pressure against the surface of the photosensitive material 1, by means of an unshown pressing means, whereby it is rotated as the photosensitive material 1** is rotatively driven. It may be directly rotated by the driving force transmitted from a motor through gears or the like.

Reference numeral 3 designates a power source for applying a bias to the charging roller 2. This power source 3, the charging roller 2, and the metal core **2*c* are electrically connected, whereby a predetermined bias is applied to the charging roller 2 by the power source 3**. As for the bias, only a DC voltage may be applied, but the application of the oscillating voltage in which a DC voltage is superimposed on an AC voltage is preferred.

As the photosensitive material 1 as the material to be charged is rotated, the peripheral surface of the photosensitive material 1 is charged to a predetermined polarity and potential by the charging roller 2, as the charging member, being pressed against the photosensitive material 1 and having been imparted with the bias voltage.

In the vicinity of the photosensitive material 1, exposing means, developing means, transferring means, cleaning means, image fixing means, and the like are disposed as essential apparatuses for image forming processes, in addition to the charging roller 2 as the above mentioned charging means, constituting an image forming system for carrying out an image forming operation. However, these processing means are omitted from this figure.

The peripheral surface of the photosensitive material in such an image forming apparatus as the above is cleaned by the cleaning blade of the cleaning means, developer, or the like as the image formation count increases. Eventually, the thickness (layer thickness, film thickness) of the photosensitive material is reduced, which changes the equivalent capacity, changing thereby the charge properties.

In particular, in the case of the DC voltage application using the contact type charging means, influence of a change in the capacity of the photosensitive material is significant. More particularly, as the image formation count increases and the film thickness of the photosensitive material is reduced, the direct current flowing to the charging roller increases, whereby the surface potential of the peripheral surface of the photosensitive material increases. Further, as the film thickness of the photosensitive material is reduced and the surface potential increases, development contrast increases and the density of the developed image increases, whereas sufficient reverse contrast cannot be obtained for the potential for the light image. As a result, the light image is slightly developed by the developer, forming a "foggy" background, which has been a problem.

That is, as the film thickness of the photosensitive material is reduced and the overall surface potential increases, the potential of the surface area which corresponds to the light image is also increased. Further, since the sensitivity of the photosensitive material decreases as the film thickness is reduced, the surface potential which corresponds to the light portion of the original, that is, the light area potential, does not decrease sufficiently during regular development. Because of the above described two phenomenons, the light potential increases greatly, reducing thereby the surface potential contrast between the dark portion and light portion of the original. As a result, if an attempt is made to obtain a sufficient development contrast during a developing process, a sufficient reverse contrast cannot be obtained for the light image potential, resulting in a problem in which the light potential portion is slightly developed by the developer, creating the "foggy" image.

If the development bias or the exposure lamp voltage (=amount of exposure by the light reflected from the image) is adjusted to prevent fogging, it is necessary to set up a sufficiently wide correction range, and this requirement of the wide correction range is a cause for cost increase involving the power source and the like.

Further, in an image forming apparatus in which a proper image forming condition is determined by means of an automatic control, it is difficult to optimize the image forming condition, because of the potential changes on the photosensitive material surface, and there is a tendency that the foggy image appears after the image forming count exceeds a certain number, and gradually grows stronger as the count progresses.

In order to avoid this phenomenon, it is necessary to provide a surface potential sensor or the like for detecting the surface potential of the photosensitive material, and the provision of such a sensor or the like increases the apparatus size and complicates the apparatus, increasing thereby the costs and creating a large obstacle against an effort for developing a small, inexpensive image forming apparatus.

SUMMARY OF THE INVENTION

An object of the present invention is to provide an image forming apparatus capable of forming an excellent image regardless of the decrease in the thickness of the image bearing material.

Another object of the present invention is to provide an image forming apparatus capable of adjusting the surface potential of the image bearing material to a predetermined value.

Another object of the present invention is to provide an image forming apparatus capable of maintaining a sufficient image density even after extended usage.

These and other objects, features and advantages of the present invention will become more apparent upon a consideration of the following description of the preferred embodiments of the present invention, taken in conjunction with the accompanying drawings.

RETAILED DESCRIPTION OF THE INVENTION

Figure 1:
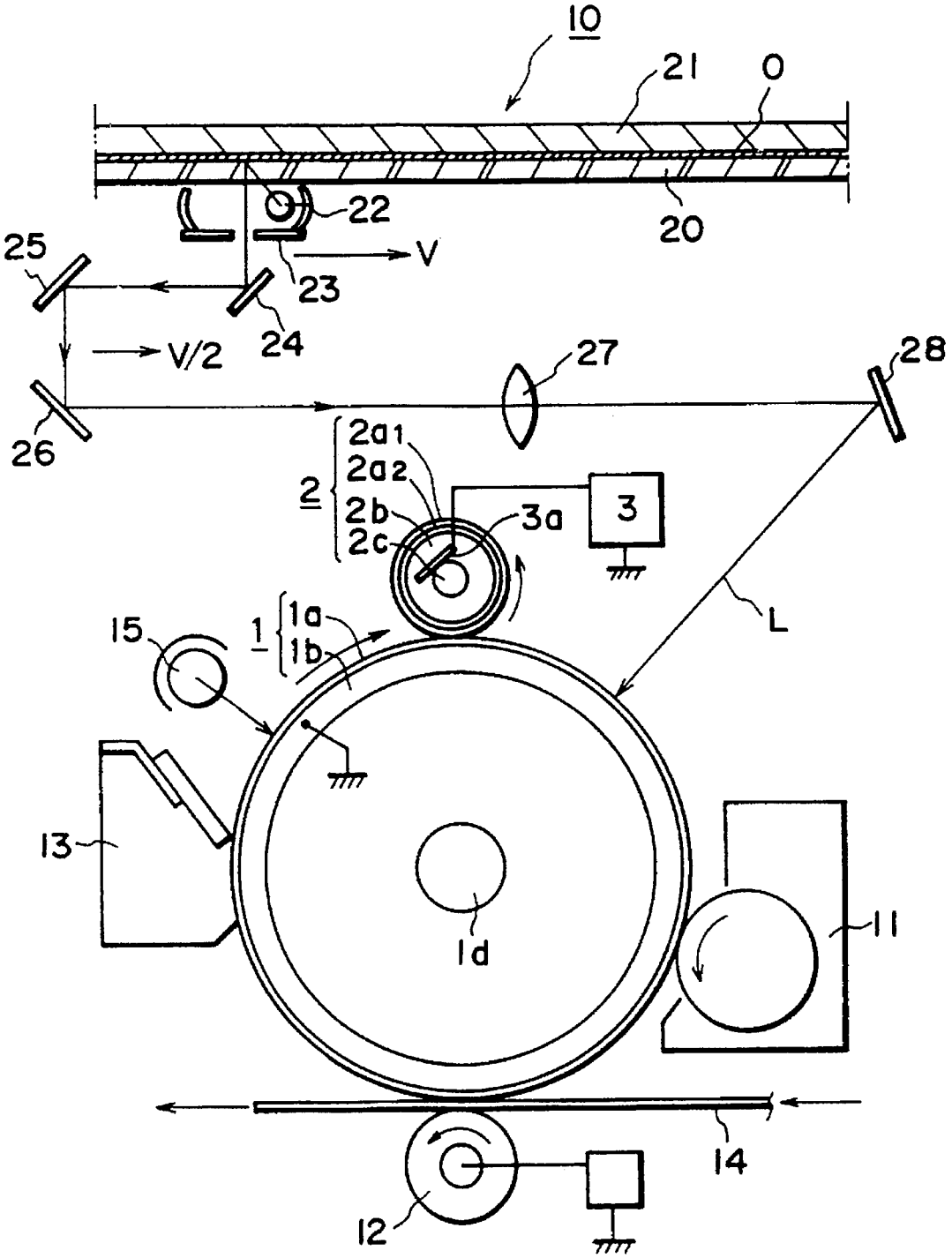
FIG. 1 is a schematic view of a preferred embodiment of the present invention, depicting the essential structure of the image forming apparatus.

The embodiments of the present invention will be described referring to the drawings.

(1) Image forming apparatus

FIG. 1 shows the fundamental structure of an image forming apparatus according to an embodiment of the present invention.

Reference numeral 1 designates an image bearing material as the material to be charged. In this embodiment, it is an electrophotographic sensitive material of a drum type, comprising basic structural layers, which are a grounded conductive base layer 1*b* made of aluminum or the like and a photoconductive layer 1*a* formed on the peripheral surface of the conductive base layer 1*b*. It is rotated about a supporting axis 1*d* at a predetermined peripheral velocity (process speed) in the clockwise direction of the drawing.

Reference numeral 2 designates a contact type charging member which imparts a primary charge on the surface of the photosensitive material so that the surface is uniformly charged to a predetermined polarity and potential, In this embodiment, it is of a roller type (charging roller). The charging roller 2 comprises a central metal core 2*c*, an electrically conductive layer 2*b* formed on the peripheral surface of the metal core 2*c*, and two resistive layers $2_{a2}$ and $2_{a1}$ formed in this order on the peripheral surface of the conductive layer. Also, the charging roller 2 is rotatably supported by unshown bearing members, with each of the end portions of the metal core 2*c* resting in the bearing, and is disposed in parallel to the drum type photosensitive material 1 while being pressed by a predetermined contact pressure against the surface of the photosensitive material 1, by means of an unshown pressing means, whereby it is rotated as the photosensitive material 1 is rotatively driven.

With this arrangement in place, the peripheral surface of the rotatable photosensitive material 1 is charged to a predetermined polarity and potential as a predetermined DC bias is applied to the metal core 2*c* from the power source 3 through a sliding contact point 3*a*. Then, the surface of the photosensitive material 1 charged uniformly by the charging member 2 is exposed to the exposure light L (focused slit exposure light reflecting the original image, scanning laser beams, or the like) carrying the data from a target image, whereby an electrostatic image reflecting the data of the target image is formed thereon.

The exposing means 10 in this embodiment is an exposing means of a known focused slit image type comprising a fixed original holder and a moving optical system. In this exposing means 10, reference numeral 20 designates a fixed original holder glass, O is an original positioned on the original holder glass 20, with the image bearing surface facing downward, 21 is an original pressing plate, 22 is an original illuminating lamp (exposure lamp), 23 is a slit plate, 24–26 are first to third movable mirrors, respectively, 27 is a focusing lens, and 28 is a fixed mirror. The lamp 22, slit plate 23, and first movable mirror 24 are moved along the bottom surface of the original holder glass from one end to the other at a predetermined speed of V, and the second and third movable mirror 25 and 26 are moved at a speed of V/2, whereby the downward facing surface of the original positioned on the original holder glass is scanned from one end to the other, which focuses the slit image of the original on the rotatable photosensitive material 1, that is, exposing the surface to the exposure light L.

Next, the latent image formed on the photosensitive material 1 surface is sequentially developed into a toner image by the developing means 11. This toner image is transferred by the transferring means 12 onto the surface of a transfer material 14 which is timely delivered in synchronization with the rotation of the photosensitive material 1, from an unshown sheet feeding means to the transfer station nip formed between the photosensitive material 1 and the transferring means 12. The transferring means 12 in this embodiment is a transfer roller, which transfers the toner image on the photosensitive material surface onto the top side surface of the transfer material 14 by means of applying a charge, which is the opposite polarity of the toner charge, from behind the transfer material 14.

The transfer material 14 on which the toner image has been transferred is separated from the photosensitive material surface, is conveyed to an unshown image fixing means, where it is fixed, and is put out as a copy. In case it is necessary to form an image on the bottom side surface, the transfer material 14 is conveyed to a return-conveying means leading to the transfer nip.

After the transfer operation, the photosensitive material surface is cleaned by the cleaning means 13 to remove the adherent contaminants such as residual toner from the transfer operation, and then, is cleared of the charge by a charge removing exposure apparatus 15, and is subjected to the repetitive image forming operation.

(2) Types of charging member 2

The roller charging member 2 may be of a type in which the charging roller is made to follow the rotation of the photosensitive material 1, that is, the material being rotated to expose different surface areas for charge, a type which is not rotatable, or a type which is directly driven to rotate at a predetermined peripheral velocity in the same direction as the photosensitive material surface or in the direction opposite thereto.

The charging member 2 may be of a blade type, block type, rod type, belt type, or the like, besides being of a roller type.

Figure 2A:
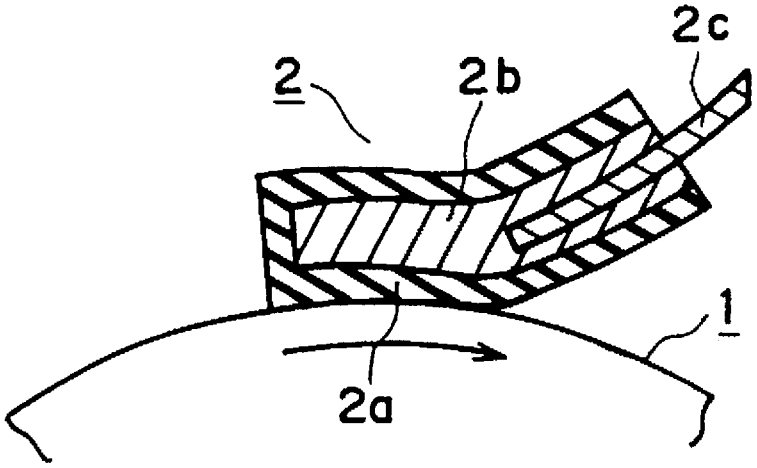
FIGS. 2A and 2B are cross-sectional schematic views of contact charging members other than the roller type contact charging member.

FIG. 2A is a cross-sectional schematic view of a blade type charging member. In this case, the orientation of the blade type charging member 2 which is placed in contact with the photosensitive material 1 surface may be the same as, or opposite to, the direction in which the photosensitive material surface is moved.

Figure 2B:
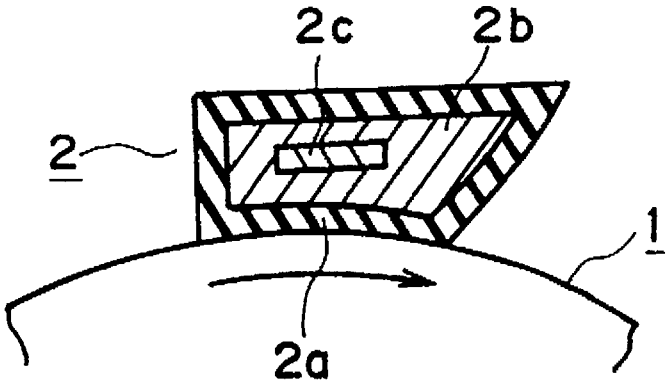

FIG. 2B is a cross-sectional schematic view of a block or rod type charging member.

In each of the various types of the charging member 2, reference code 2*c* designates a core of metallic material, and 2*b* is an electrically conductive layer and 2*a* is a resistive layer.

In the block or rod type, a lead wire leading to the power source 3 can be directly connected to the metallic core 2*c*, eliminating a need for a power supply sliding contact 3*a* which is required in the rotatable roller type to apply the bias voltage to the metallic core 2*c*. This arrangement not only offers an advantage in that the electrical noises which are likely to be generated from the power supplying sliding contact 3*a* are eliminated, but also makes it possible to save space, and to use the charging member 2 also as the cleaning blade for the surface of the material to be charged.

(3) Sequence

Figure 3:
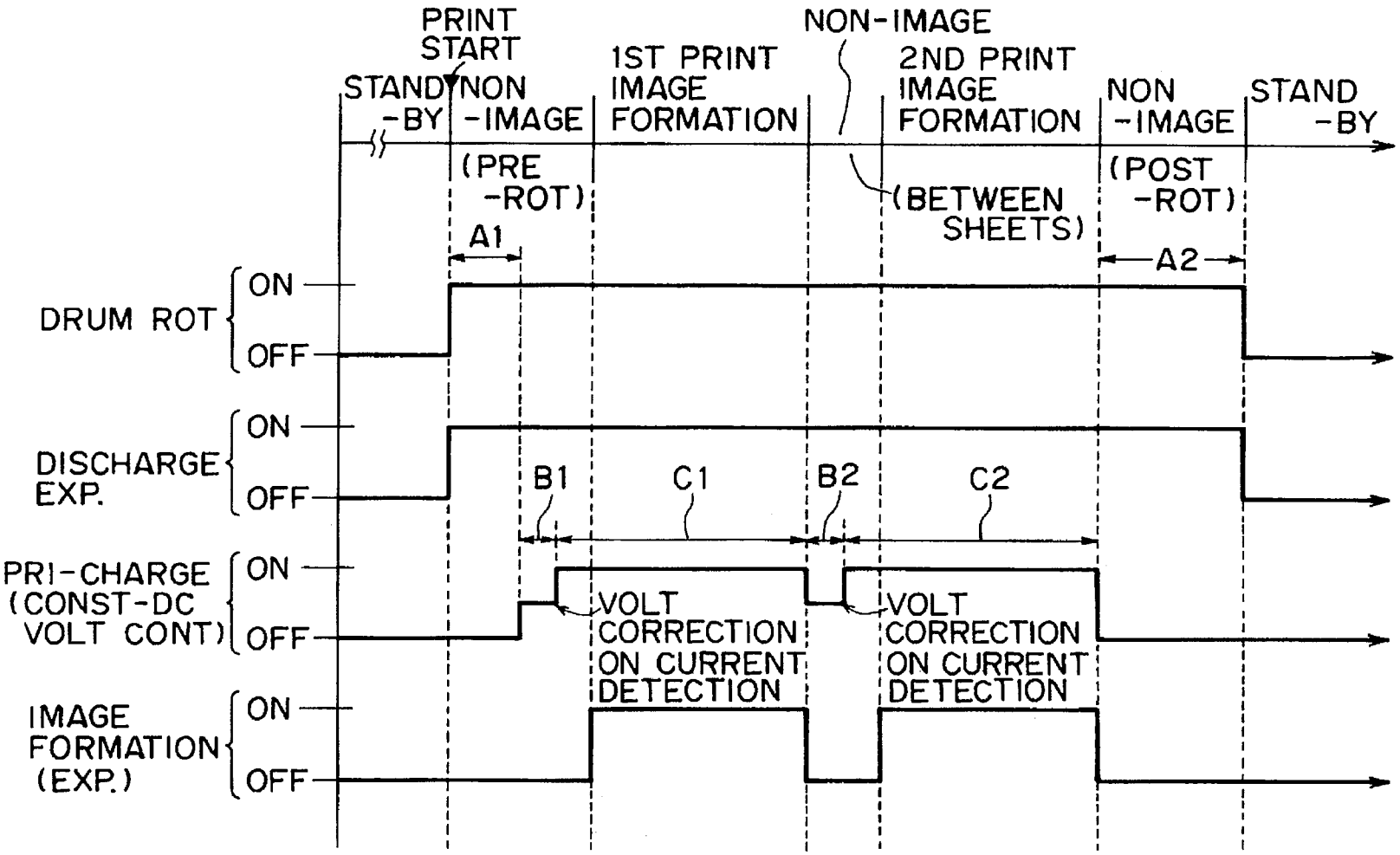
FIG. 3 is a sequence diagram for the apparatus operation.

FIG. 3 is an operational sequence for the apparatus shown in FIG. 1. This depicts a case in which two copies are consecutively made.

1. The photosensitive material 1 (hereinafter, referred to as a drum) being on standby in the apparatus begins to be rotated in response to a print (copy) start signal, which marks the beginning of a pro-rotation period. As soon as the rotation of this drum begins, the charge removing exposure lamp 15 is turned on, whereby the drum 1 is rotated more than one peripheral distance in the segment A to be cleared of the charge.

2. Then, the power source 3 is turned on to supply a DC bias, that is, the primary charge bias applied to the charging roller 2, that is, the contact type charging member.

3. The primary bias applied to the charging roller is at first constant-voltage controlled by a constant-voltage control circuit of the power source 3 in the segment B, in which the DC current flowing through the charging roller is detected by a current detecting circuit of the power source 3. Next, the charging roller is constant-DC voltage controlled using a voltage which corresponds to the detected DC current.

A period from when the print start signal is inputted until the image formation begins is a drum pre-rotation period. The charging roller 2 is constant-DC voltage controlled in the segment B1 during this pre-rotation period, which is a period when the drum surface remains to be the non-image forming region, and during this period, the DC current is detected and the primary voltage is corrected (the primary charge bias applied to the charging roller 2 is corrected).

4. After the charge roller begins to be constant-DC voltage controlled by the corrected primary voltage, an image forming operation for the first print is initiated by the image exposure light (the slit image of the original is focused for exposure), wherein in a segment C1, the charging roller 2 faces the drum surface which now is serving as the image forming area, and charges the drum surface while being constant-DC voltage controlled.

5. A portion of the drum surface which corresponds to a period from the completion of the image formation for the first print to the beginning of the image formation for the second print, that is, a sheet absent period, is a non-image forming area, and the transfer material does not contact the drum surface. In this embodiment, the charging roller 2 is subjected, again in this sheet absent period, to the sequence of the constant-DC voltage control, DC current detection, and constant-DC voltage control, as it is in the previous sheet absent period.

In other words, in the segment B2 of the sheet absent period following the completion of the first print, the primary charge bias applied to the charging roller is again placed under the constant-DC voltage control, the DC current is detected, and the charging roller is constant-voltage controlled in response to the detected current, before initiating the image formation for the second print.

When more than three prints are consecutively made, the sequence of the constant-DC voltage control of the charging roller. DC current detection, and resultant constant-DC voltage control is carried out in the same manner during each interval between the transfer materials.

6. After the completion of the last print, the drum 1 enters a post-rotation period. In the segment A2 of this post-rotation period, the drum 1 is rotated more than one peripheral distance to be cleared of the charge, by the charge removing exposure lamp 15. Then, the rotation of the drum 1 is stopped, the charge removing exposure light is turned off, and the apparatus remains on standby until the next print start signal is inputted.

In the above described structure, as the drum surface is gradually shaved through an extended usage, and therefore, the thickness of the photosensitive material film is reduced, the DC current detected in the segments B1 or B2, in which the charging roller 2 facing the non-image forming surface area of the drum 1 is constant-DC voltage controlled, increases, and the image forming surface area of the drum 1 is charged for the image formation by the charging roller 2 being constant-DC voltage controlled using a voltage corrected to be lower in response to this increase in the detected DC current. Therefore, the drum 1 can be charged to the same potential as the time when the drum has not been shaved.

When the resistance of the charging roller 2 increases in a low humidity environment, for example, 15° C. and 10% RH, the DC current detected in the segment B1 or B2 in which the charging roller 2 is constant-DC voltage controlled decreases. At this time, the image forming surface area of the drum 1 is charged for the image formation, by the charging roller 2 being constant-DC voltage controlled using a voltage corrected to be higher in response to this decrease in the detected DC current, and therefore, the charge potential of the drum 1 remains stable regardless of the environment dependent resistance change of the charging roller 2.

(4) Method for correcting voltage

Next, descriptions are given to methods for effecting an optimum charge using the power source 3.

First, a charging mechanism is described in regard to a case in which a DC voltage is applied to the charging roller 2 using a DC power source.

As for the photosensitive material 1, an OPC photosensitive drum of negative polarity was used. In practical terms, the photosensitive material was an organic semiconductor layer of negative polarity comprising a CGL (carrier generating layer) of azo pigment, and a CTL (carrier transfer layer) of 24 μm thick mixture between hydrazone and resin, which is laminated on the CGL. The OPC photosensitive drum 1 was charged in darkness through the contact between this OPC photosensitive drum 1, being rotated, and the charging roller 2, being placed in contact with the surface of the drum and being imparted with a DC voltage $V_{DC}$, and a surface potential $V_D$ of the charged OPC photosensitive drum 1 after passing by the charging roller 2, and a DC voltage $V_{DC}$ applied to the charging roller 2, are measured to learn their relation.

Figure 4A:
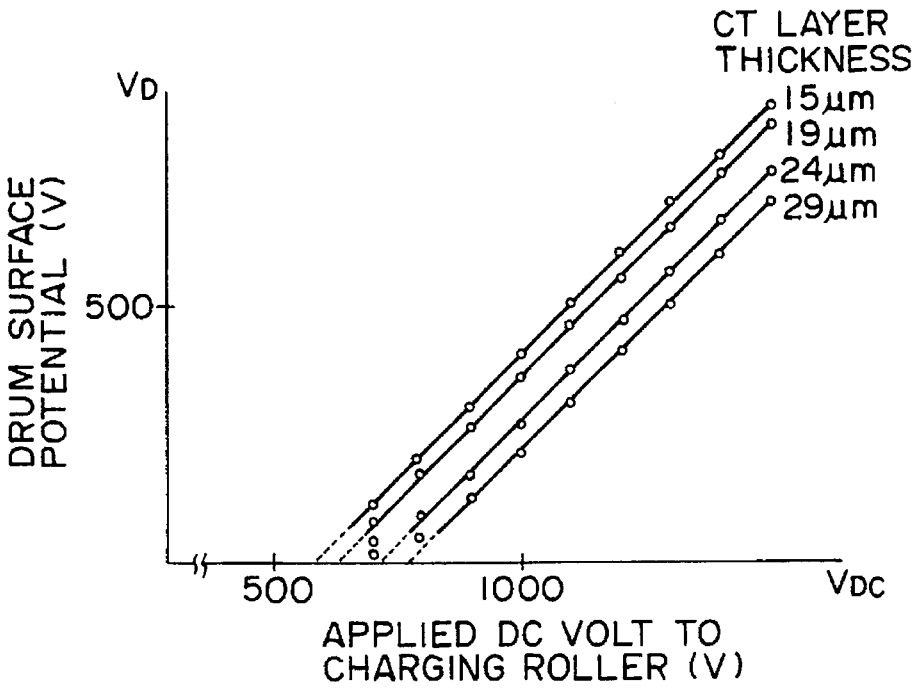
FIGS. 4A and 4B are graphs of charge characteristic curve.
Figure 4B:
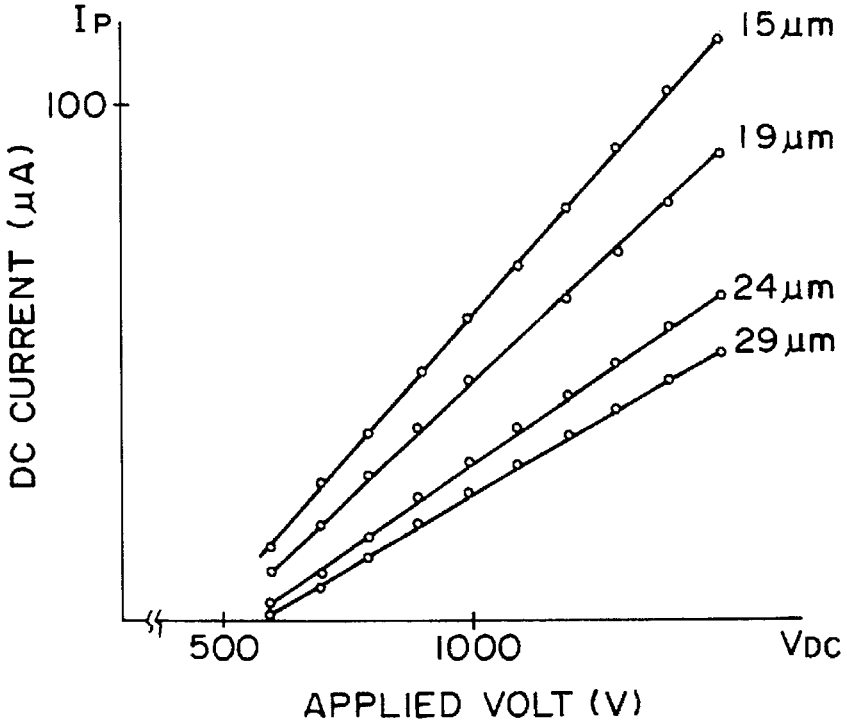

The straight line corresponding to 24 μm in the graph in FIG. 4 shows the results of this measurement. FIG. 4A shows threshold values of the applied DC voltages $V_{DC}$, for respective drum film thicknesses. In other words, the drum 1 begins to be actually charged at a specific voltage, and the relation is linear between the applied DC voltage having an absolute value exceeding the threshold value and the surface potential $V_D$ obtained in response to this applied voltage.

Here, the charge start voltage is defined as follows. That is, while only a DC voltage is applied to a charging member for charging an image bearing member having zero potential, this DC voltage is gradually increased, and the surface voltage of the photosensitive material, that is, the image bearing member, is graphed in relation to the applied DC voltage. The DC voltage scale is graduated in a unit of 100 V, wherein the surface voltage is measured in relation to each of ten DC voltage points which are selected, with intervals of 100 V, the first point being a point at which the surface potential appears in relation to the surface voltage of zero. Then, a straight line is drawn using the so-called statistical least squares method, and the voltage reading at a point on the applied DC voltage scale where this straight line intersects with the applied DC voltage scale, that is, where the surface potential is zero, is defined as the charge start voltage. The graphs in FIG. 4 are drawn using the above mentioned least squares method.

There is a relation as follows, with $V_{DC}$ being the applied DC voltage to the charging roller 2, $V_D$ being the surface potential of the OPC photosensitive drum 1, and $V_{TH}$ being the charge start voltage:

$$V_D=V_{DC}-V_{TH} \quad (1)$$

The above Equation (1) can be derived using the Pasoben's law.

Figure 5:
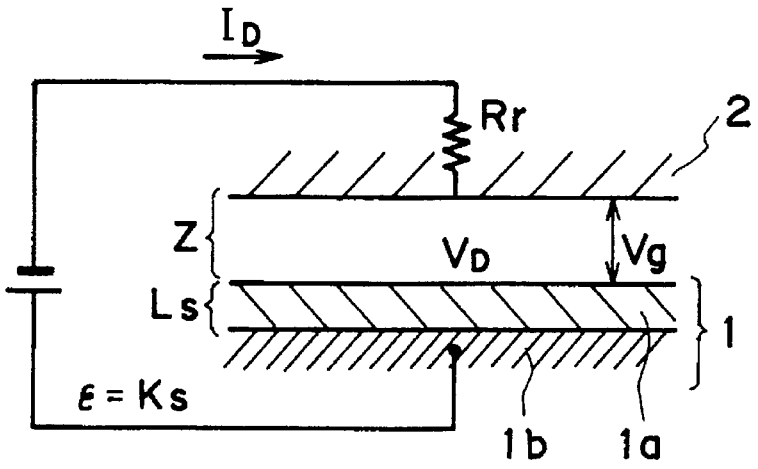
FIG. 5 is a diagram of an equivalent circuit formed in a microscopic gap in the interface between the photosensitive material layer end charging roller.

FIG. 5 shows an equivalent circuit formed in the microscopic gap Z in the contact nip formed between the charging roller 2 and OPC photosensitive layer. When a total resistance $R_r$ of the charging roller 2 is small, a voltage drop $I_D R_r$ induced by a current $I_D$ flowing through the photosensitive layer 1*a* is sufficiently small to be ignored. First, ignoring the $R_r$, a voltage $V_g$ across the gap Z is expressed by the following equation:

$$V_g=V_{DC}\cdot Z/(L_S/K_S+Z) \quad (2)$$

$V_{DC}$: applied voltage

Z: Gap $L_S$: Thickness of photosensitive layer $K_S$: Dielectric constant of photosensitive layer As for the discharging phenomenon In the gap Z, an air gap breakdown voltage $V_b$, with Z being 8 μ or more, can be approximated by the following linear equations (3) and (4), based on Paschen's law.

$$V_b=312+6.2Z\ (V_b>0) \quad (3)$$

$$V_b=-(312+6.2Z)\ (V_b<0) \quad (4)$$

Figure 6:
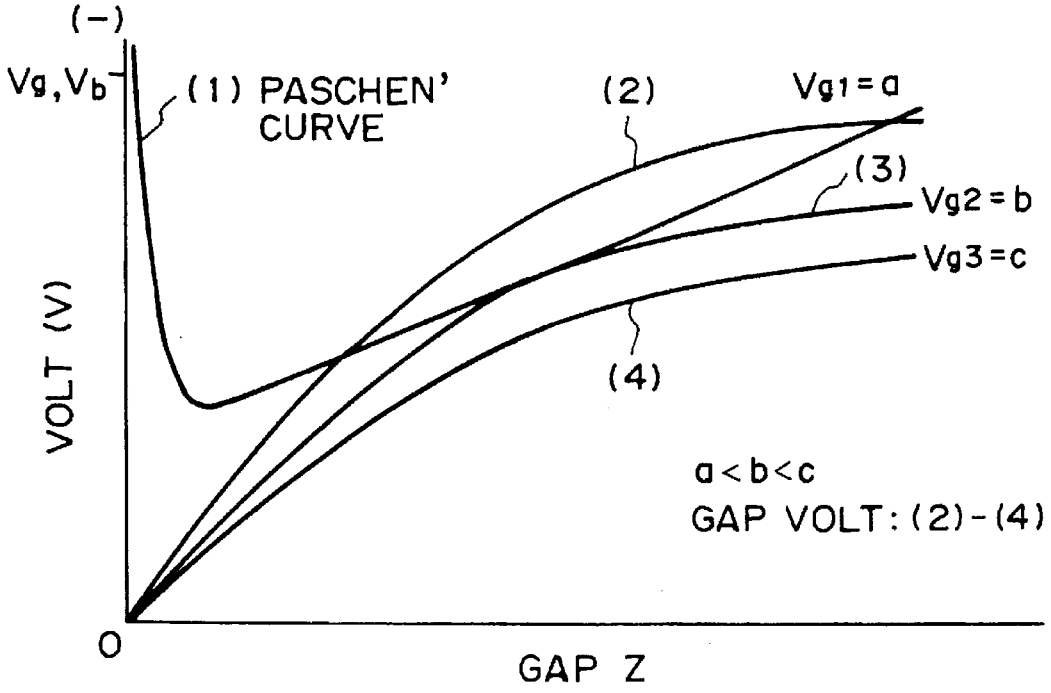
FIG. 6 is a graph showing the relation between the air gap and the air gap breakdown voltage.

Since $V_b<0$, the graphs drawn according to equations (2) and (4) are as shown in FIG. 6. The axis of abscissa represents the gap distance, and the axis of ordinate represents the air gap breakdown voltage. The concave-shape (1) is the Paschen's curve, and the convex-shaped curves (2), (3) and (4) are the characteristic curves for the air gap breakdown voltage V, with Z being the parameter.

Discharge occurs in the case where the Paschen's curve (1) intersects with the curves (2) to (4). At the points where the discharge begins, the discriminant of a quadratic equation regarding the Z obtained by substituting $V_g$ by $V_b$ becomes zero. Since the point is the discharge start limit, $V_{DC}$ equals $V_{TH}$.

Paschen's law is related to the discharge phenomenon across a gap. However, generation of ozone, though being extremely small amount ($10^{-2}$–$10^{-3}$, in comparison to the corona discharge) is observed right next to the charging area during the charging process using the above described charging roller 2, suggesting a possibility that the charging by the charging roller is related to the discharge phenomenon. Therefore, equation (5) is used to control the $V_D$ through the $V_{DC}$:

$$V_{DC}=V_R+V_{TH} \quad (5)$$

$V_R$: target surface potential wherein the target potential value $V_R$ is selected to obtain the $V_{TH}$, which is added to make the $V_D$ closer to the $V_R$.

Here, as is evident from equation (5), a threshold voltage $V_{TH}$ is determined by equation (6):

$$D=L_S/K_S \quad (6)$$

wherein the dielectric constant $K_S$ of the photosensitive layer is influenced by the ambient temperature and humidity of the photosensitive material, and the $L_S$ of the photosensitive layer decreases through extended usage.

Therefore, the surface potential $V_D$ changes in response to the fluctuation of the threshold voltage value which is dependent on the ambient conditions and the duration of the apparatus usage. In other words, the DC voltage value $V_{DC}$ for obtaining a proper surface potential value $V_D$ can be obtained by knowing the values for $K_S$ and $L_S$.

Figure 7A:
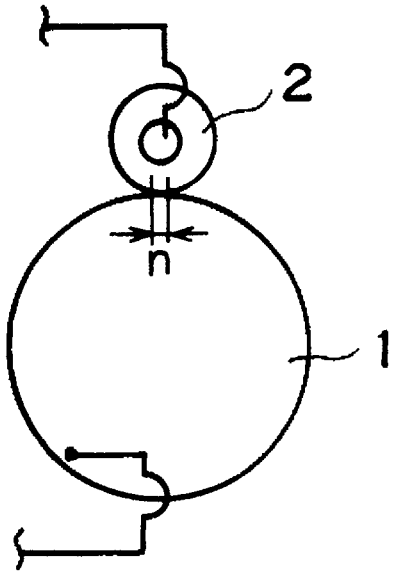
FIGS. 7A and 7B are schematic views of a contact nip between the photosensitive material and charging roller, and an equivalent circuit diagram therein, respectively.
Figure 7B:
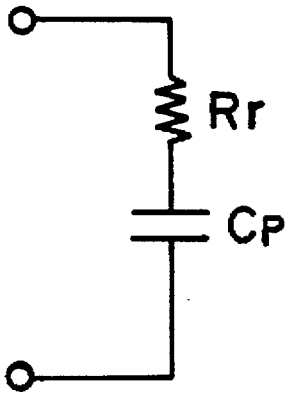

Here, a capacitance $C_P$ formed by the photosensitive drum i and the charging roller 2 is formed, as shown in FIGS. 7A and 7B, by the nip n formed where the drum 1 and roller 2 make contact. With $S_P$ being a contact surface area in the nip, an equation is derived based on FIG. 7B:

$$C_P=S_P\times K_S/L_S=S/D \quad (7)$$

In other words, $C_P\propto 1/D$. Therefore, if $C_P$ is known, the proper DC voltage $V_{DC}$ can be obtained using equation (5).

In this embodiment, instead of specifying the $C_P$ of the drum (photosensitive material), the charge characteristic changes caused by the change of the discharge impedance influenced by the film thickness (above mentioned $L_S$) of the charge transfer layer (CT layer) of the drum are simply measured, and based on these measurements, the $C_P$ changes of the photosensitive material are estimated. Then, these estimates are used to correct the voltage to be applied.

Figure 8A:
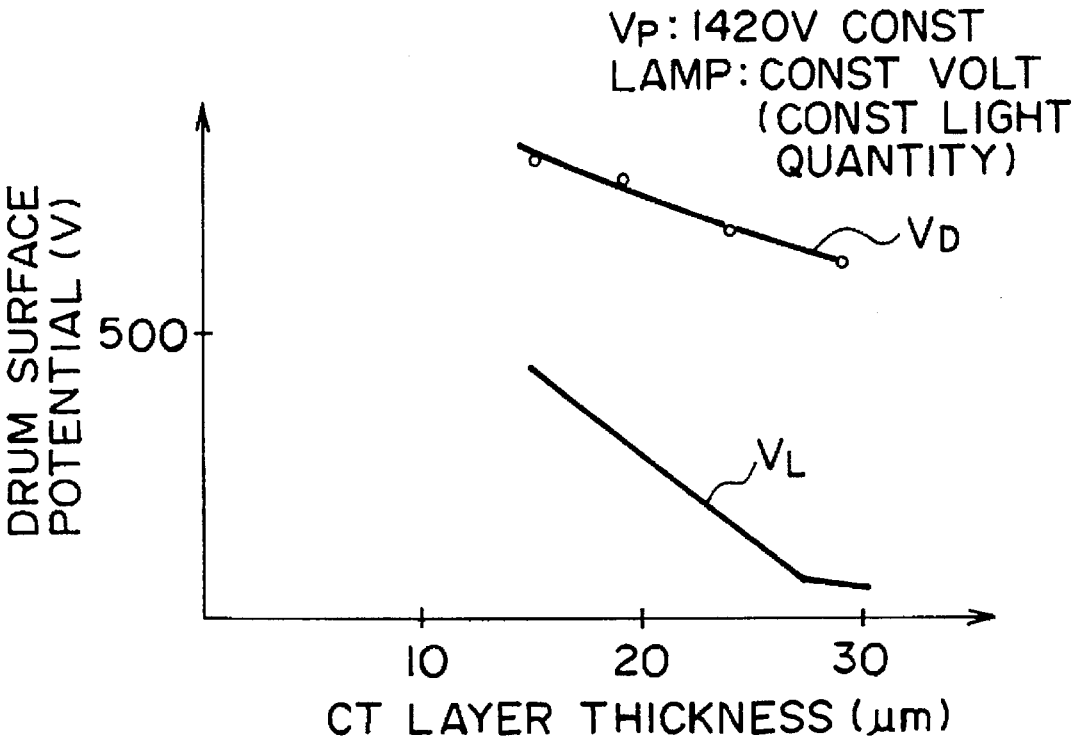
FIGS. 8A and 8B are graphs showing the film thickness dependency of charge capacity.
Figure 8B:
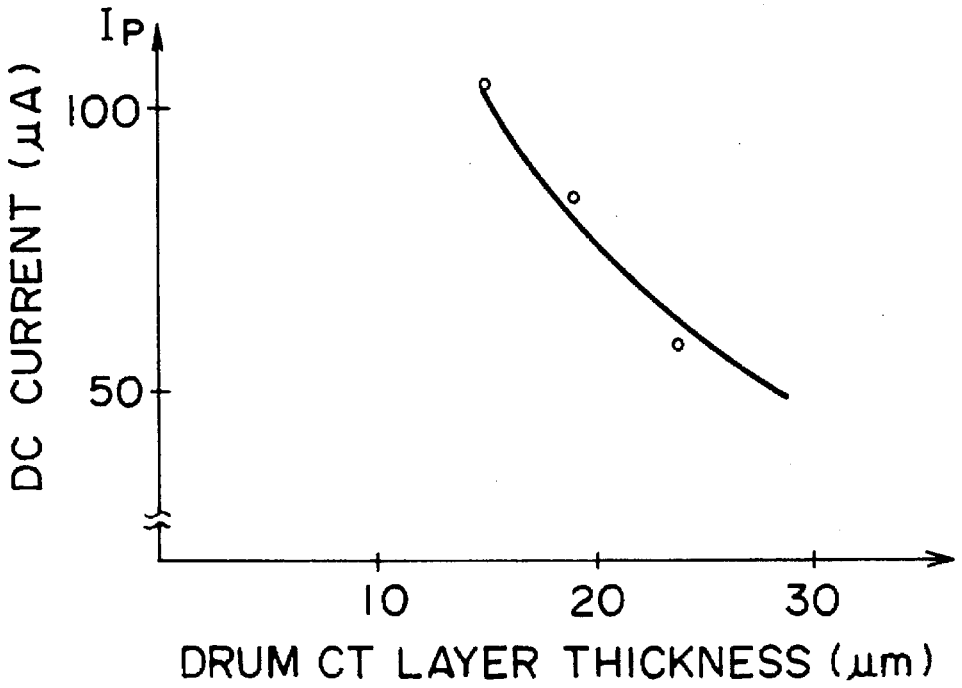

FIG. 4A shows the relation between the measured voltage applied to the charging roller 2 and the measured potential of the drum surface, for respective CT layer thicknesses of the drum. Also, in FIG. 4B, the amount of the DC current corresponding to each thickness is shown in the same manner. As evident from this figure, it can be understood that the charge characteristics, voltage-current characteristics, or discharge start voltage are affected by the thickness of the CT layer of the drum.

in FIGS. 8A and 8B, this characteristic as the drum surface potential and CT layer thickness vs. the DC current. It is evident that the drum surface potential (dark portion potential $V_D$ and light portion potential $V_L$) and the amount of the DC current increase as the CT layer becomes thinner. In other words, it is clear that the surface potential corresponding to the $C_P$ of the drum can be estimated by means of measuring the amount of the DC current during the application of a specific constant voltage.

Figure 9:
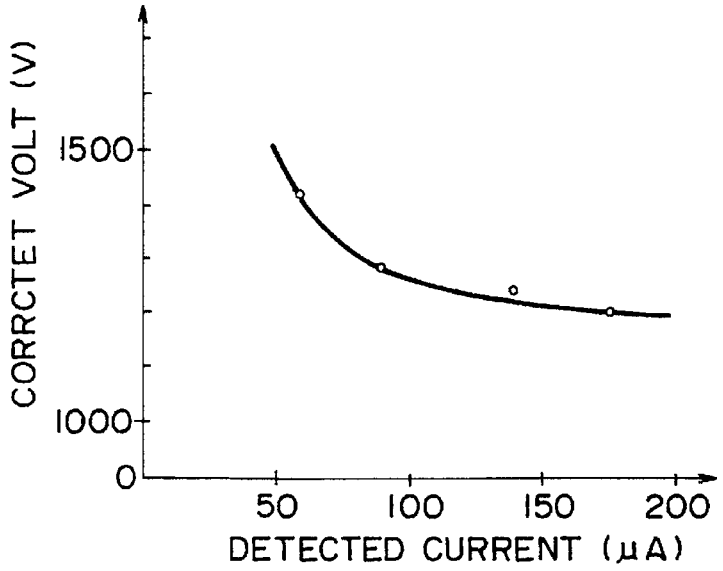
FIG. 9 is a graph showing the relation between the detected current and the corrected voltage output value.
Figure 10A:
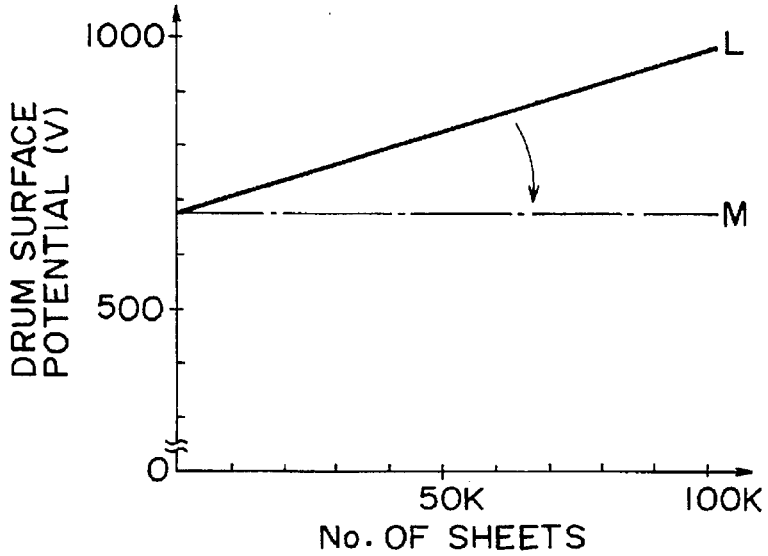
FIGS. 10A and 10B are drawings for explaining the effects of the sheet count.
Figure 10B:
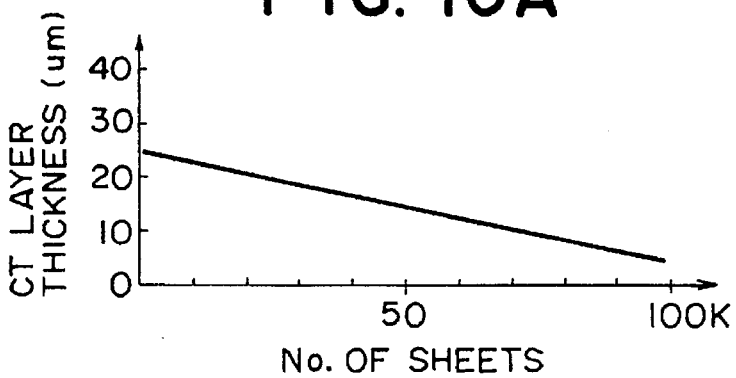

FIG. 9 shows the relation between the amount of detected current and the corrected voltage output, to be used for optimizing the drum surface potential in response to the $C_P$ changes due to the drum CT thickness changes. The correction is made so as to decrease the voltage output as the amount of detected current increases. The test results using this correction are given in FIGS. 10A and 10B.

The number of sheets as the image formation count is plotted on the axis of abscissa, showing the change in the drum surface potential corresponding to respective numbers. When a specific constant voltage is applied to the charging member regardless of the image formation count, a surface potential deviation is expressed by L. If the amount of DC current is detected when a constant voltage is applied to the charging member in a manner as shown in this embodiment, and then, the applied voltage is corrected in response to the amount of detected current so that the corrected constant voltage is to be applied, a stable drum surface potential can be secured even if the sheet number increases to the number designated by M.

In this experiment, the above described OPC photosensitive drum was used. Also, durability tests were conducted using the image forming apparatus shown in FIG. 1.

As for the charging roller 2, a rubber layer 2*b* of EPDM or the like, having a conductivity of 104–105 Ωcm is provided on a metallic core 2*c*, and a middle layer $\mathbf{2}_{a2}$ of hydrine rubber or the like, having conductivity of 107–109 Ωcm, is provided on this rubber layer 2*b*. Next, a blocking layer $\mathbf{2}_{a1}$ of a nylon group substance such as TORAYZIN (trade name of Teikoku Chemistry Inc.) is provided as the surface layer on this middle layer $\mathbf{2}_{a2}$. The hardness was in a range of 50°–70° on the Asker—C scale. This charging roller 2 was placed in contact with the photosensitive drum 1, holding a total contact pressure of 1600 g, being rotated thereby to charge the photosensitive drum 1.

If the resistance value of the resistive layer of the charging member increases because of the ambient humidity change or extended usage, the amount of detected current decreases, whereby an correction is made to increase the value of the voltage applied during the image forming period. Therefore, there is no insufficient charge, affecting always sufficient image density and image quality.

Next, an operational sequence for the apparatus is described referring to another embodiment.

Figure 11:
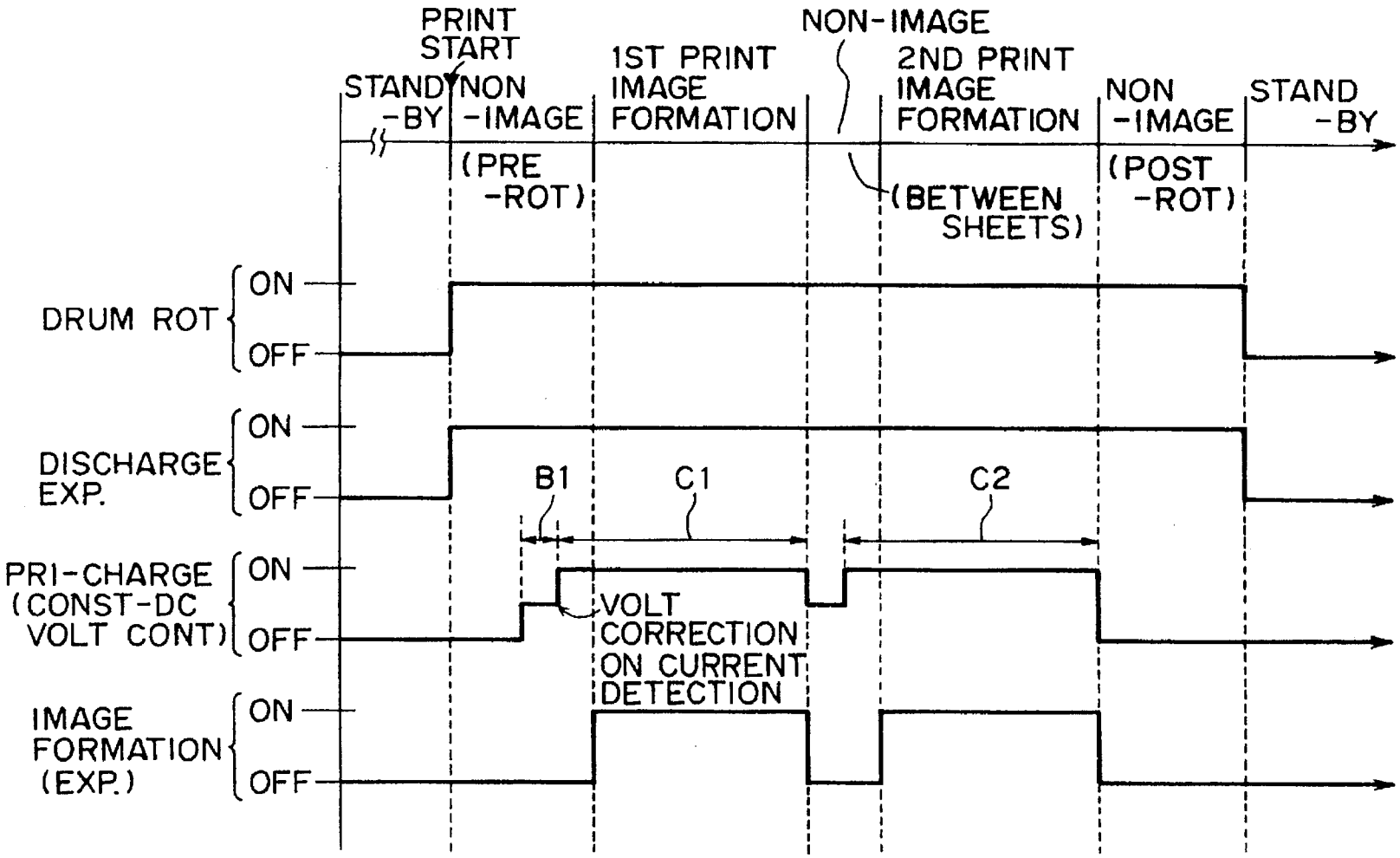
FIG. 11 is a sequence diagram for the second embodiment.

The sequence in FIG. 11 is comparable to the sequence in the above mentioned FIG. 3, except that while prints are consecutively made, the constant-DC voltage control of the charging roller 2 and the DC current detection therein are conducted only in the segment B1 during the pro-rotation period of the drum 1, and that the constant-DC voltage control and the DC current detection are not conducted during the sheet absent period.

While the prints are consecutively made, the charging roller is constant-voltage controlled in response to the DC current detected in the segment B1.

However, the voltage is re-corrected in response to the detected DC current in the segment B1 during the drum pre-rotation period for the next printing session.

A different sequence according to another embodiment will be described.

Figure 12:
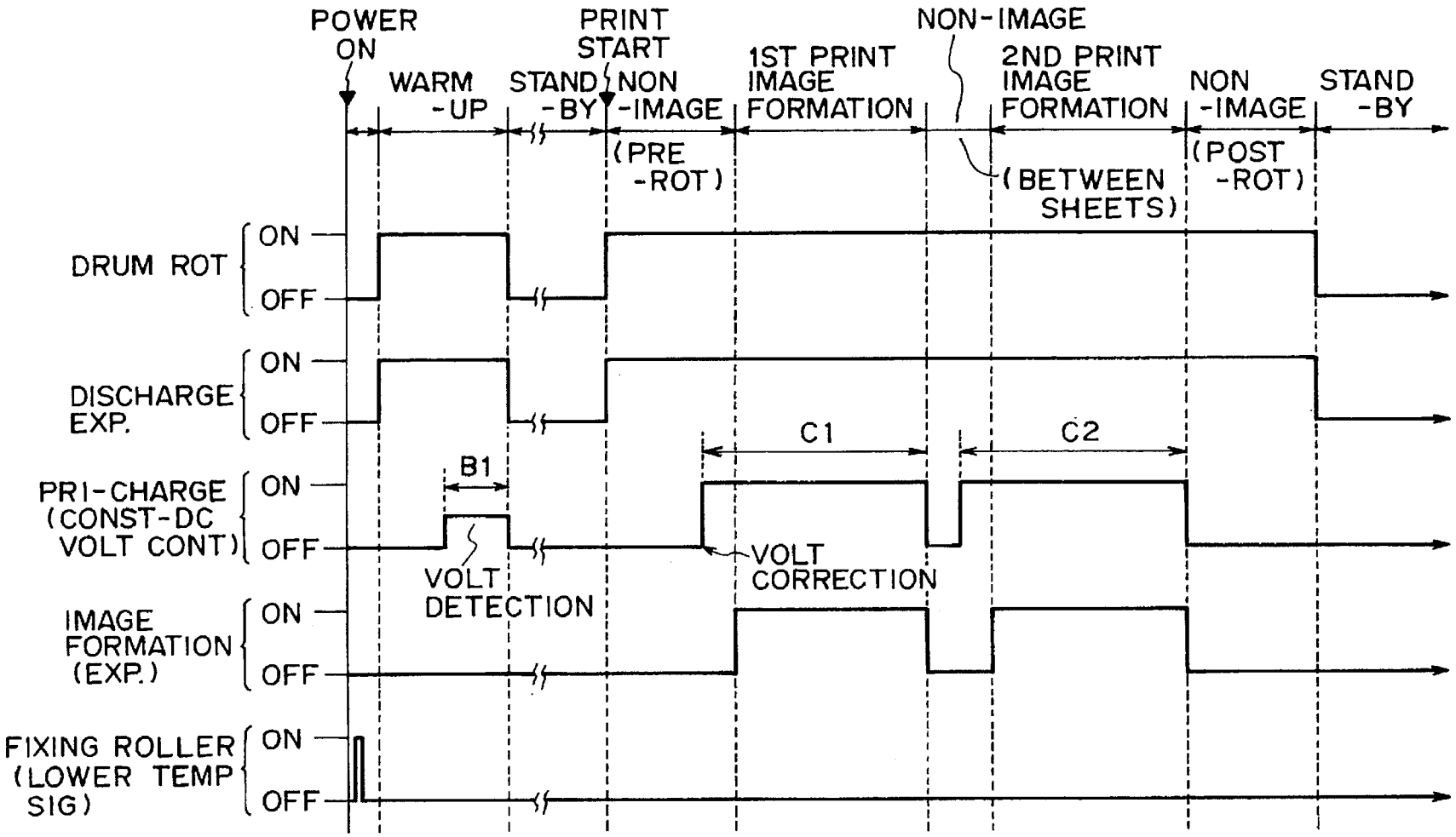
FIG. 12 is a sequence diagram for the third embodiment.

In the sequence shown in FIG. 12, the constant-DC voltage control of the charging roller 2 and the DC current detection therein are conducted immediately after the power to the apparatus is turned on, that is, during the pre-rotation period (apparatus warmup period) in which the image fixing apparatus or the like is warmed up.

After the apparatus is warmed up, the drum rotation is stopped, the charging removing exposure light is turned off, and the apparatus remains on standby until a print start signal is inputted.

The primary charge bias of the charging roller during each image forming cycle after the print start signal is inputted is constant-DC voltage controlled for the image formation, in response to the DC current detected during the constant-DC voltage control executed during the above described warmup period.

The DC current detected and the voltage corrected in the above described manner are retained until the power source of the apparatus is turned off.

The timing for this detection may be scheduled to be once a day, that is, only once at the beginning of the work day schedule (or "first in the morning"), which will be effective for stabilizing the image density. For example, even if the power source of the apparatus is turned off for a short time to take care of a paper jam in the apparatus, the current detection is carried out again when the power is turned on again, and the corrected voltage is re-corrected. In other words, there is a chance that the values of the corrected voltage before the power source is turned off and after it is turned off varies depending on the current detection accuracy, and even if the corrected voltage changed ever so slightly, an apparatus operator can notice a Substantial difference if the change occurs in a short time, resetting thereby the density setting value during the image formation.

Contrarily, in order to improve the operational performance of the image forming apparatus, the sequence comprising the constant-DC voltage control of the charging roller, current detection therein, and the constant-voltage control using the corrected voltage is carried out only once at the time when the apparatus is started up at the beginning of the work day schedule, and this corrected constant-voltage is retained for the day.

As the results of practical application tests, a method effective as a means for determining whether the apparatus is in the "first in the morning" condition was found to be a method in which the apparatus was determined to be in the "first in the morning" condition if the detected temperature of the fixing roller in the fixing apparatus was below a specific temperature at the time when the power to the image forming apparatus was turned on. Here, it was effective to choose this specific temperature in a range between 30° C. to 130° C., and in particular, it was most effective if it was selected to be approximately 100° C.

Another sequence for the apparatus will be described.

If the charging roller 2 as the charging member displays non-uniform surface resistance in the peripheral direction, and the DC current is detected only once during the constant-DC voltage control of the charging roller 2, the following problem arises; if it happens that the current flowing through the charging roller portion having a lower resistance in the peripheral direction is detected, the higher current is detected, and therefore, the value of the constant-voltage obtained after the correction becomes lower, reducing thereby the charge potential during the image formation. In the case of normal development, the image density is reduced, and in the case of reversal development, the image density is increased, which is likely to cause imaging trouble such as fogging.

Figure 13:
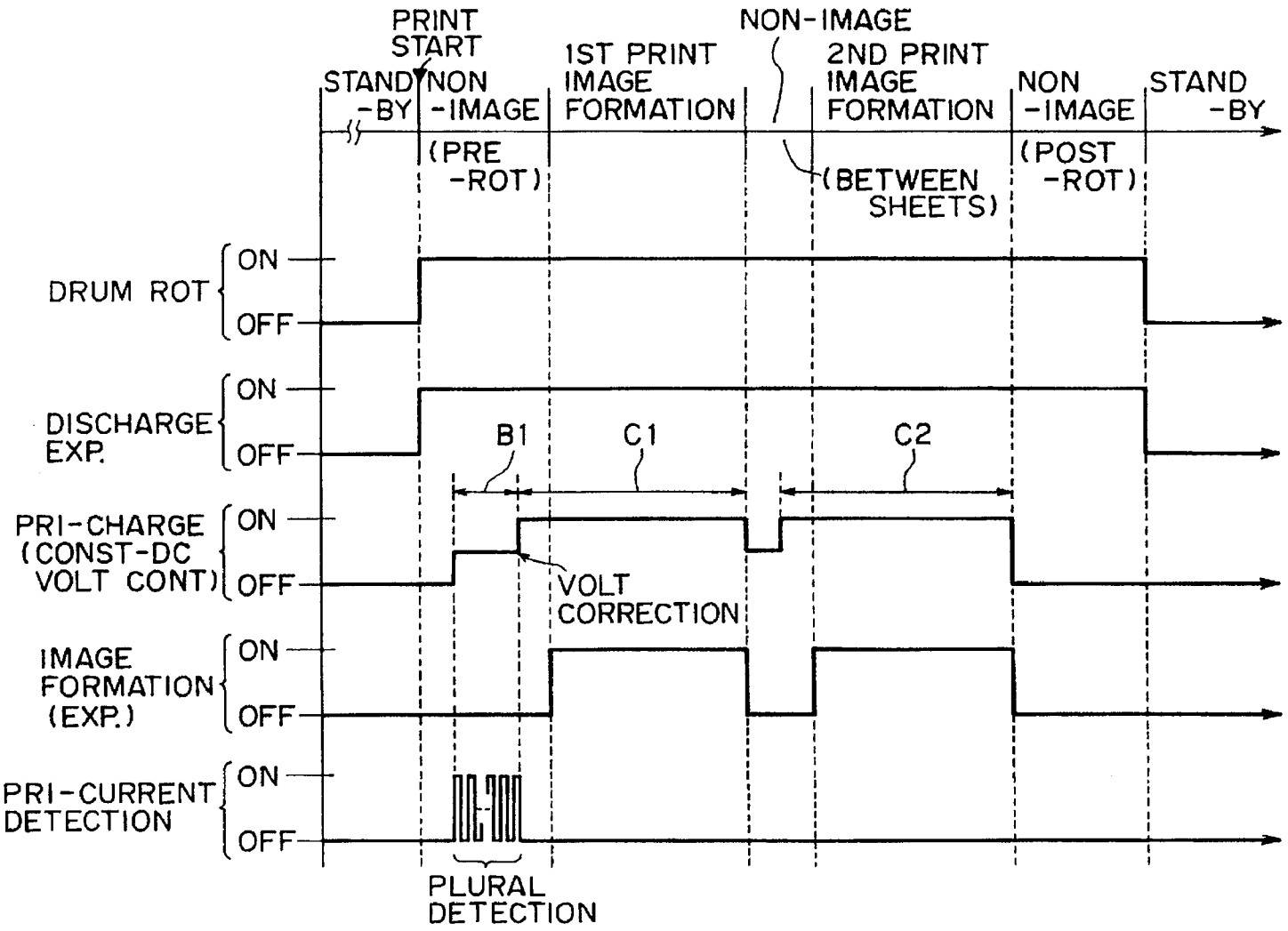
FIG. 13 is a sequence diagram for the fourth embodiment.

In order to solve the problem of image density variance deriving from the difference in the detected current in the peripheral direction of the charging roller, the DC current detection is carried out a number of times in this embodiment during the constant-DC voltage control as the sequence in FIG. 13 shows, and the corresponding number of detected DC current values are added or integrated to obtain their average value. During the image formation, the charging roller 2 is constant-voltage controlled using a voltage corrected in response to the average of the detected current values. Further, methods other than the above one are also acceptable. For example, the maximum and minimum values may be eliminated from the number of detected DC current values.

According to the above described methods, a stable current value and corrected voltage value can be obtained even if resistive non-uniformity exists in the peripheral direction of the charging roller 2.

As stated with reference to the above embodiment, even if the thickness of the photosensitive material is reduced as the image formation count increases, whereby the capacity of the photosensitive material changes, an optimally corrected voltage can be applied to the charging member by means of detecting each time the voltage-current characteristic reflecting the capacity which corresponds to the then thickness of the photosensitive material.

As a method for implementing the above concept, the charging member is constant-DC voltage controlled during the non-imaging period, and then, the constant-voltage control during the image forming period is carried out using a voltage corrected in response to the amount of the detected current.

In other words, as the thickness of the photosensitive material decreases, the amount of current detected during the non-image forming period under the constant-voltage control increases, but since the voltage to be applied to the charging member during the image forming period is corrected in response to the above increased voltage amount, the charging process is carried out in the optimal condition, whereby the image forming operation is carried out in the optimal condition.

When the resistance of the charging roller 2 increases because the resistive layer displays changes caused by factors such as ambient humidity changes or extended usage, the detected DC current decreases, but since the correction is made to increase the voltage to be applied during the image formation, the charge is never insufficient, and a satisfactory image density and image quality can be always obtained.

Hereinafter, the image forming apparatus will be described referring to another embodiment of the present.

The mechanical structure of this image forming apparatus is the same as the one shown in FIG. 1.

Figure 14:
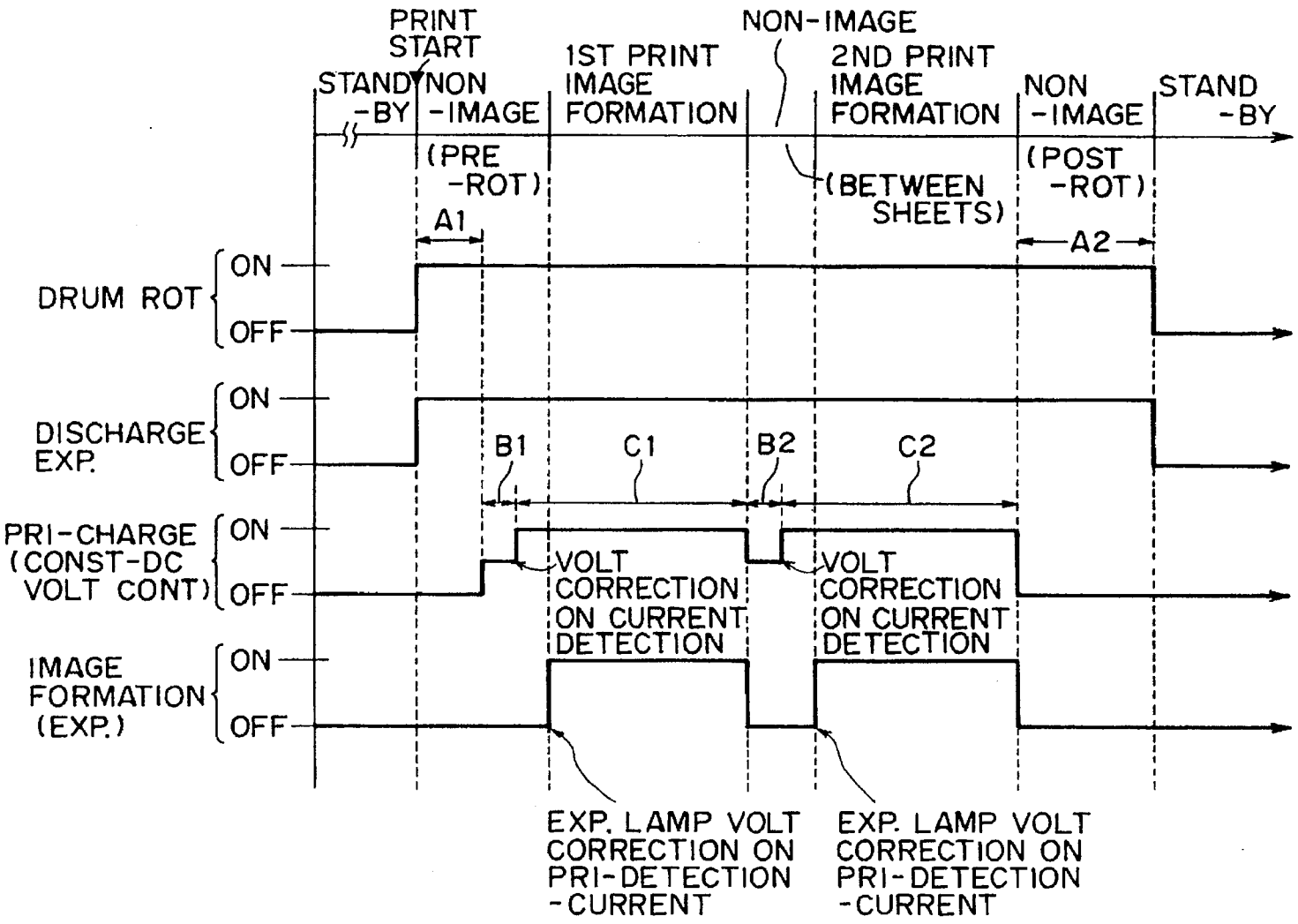
FIG. 14 is a sequence diagram for the fifth embodiment.

FIG. 14 shows an operational sequence for the apparatus according to this embodiment of the present invention. Generally speaking, it is the same as the one in FIG. 3. In this embodiment, the DC current detection, primary voltage correction, and correction of the voltage applied to the image exposure lamp 22 are carried out while the charging roller is constant-DC voltage controlled in the segment B1 of the drum pre-rotation period.

As soon as the charging roller begins to be constant-DC voltage controlled using the corrected primary voltage, the image forming operation is carried out for the first print using the exposure light L imparted with the corrected lamp voltage.

In addition, the constant-DC voltage control of the charging roller 2, DC current detection, constant-DC voltage control, and lamp voltage control are carried out also in the sheet absent period between the first and second prints. In other words, in the segment B1 of the sheet absent period after the completion of the first print, the charging roller is again placed under the constant-PC voltage control by the primary bias, DC current is detected, and in response to the detected DC current, the primary constant-voltage control and the lamp voltage control are carried out to form the image for the second print.

When more than three prints are consecutively made, the sequence of the constant-DC voltage control of the charging roller, DC current detection, constant-DC voltage control, and lamp voltage control is carried out in the same manner in each of the sheet absent periods.

When the drum surface is shaved through extended usage and the photosensitive film thickness decreases, the DC current detected in the segments B1 or B2 in which the charging roller 2, being in contact with the drum 1 surface area serving now as non-image forming area, is constant-DC voltage controlled, increases. The image forming surface area of the drum 1 is charged by the charging roller 2 being constant-DC voltage controlled using the voltage corrected to be lower in response to the then detected DC current, and the exposure amount is corrected through the lamp voltage control, for the image forming period. The above mentioned voltage correction is made to keep constant the photosensitive material potential, regardless of the decrease in the photosensitive material film thickness.

Further, when the resistance of the charging roller 2 increases due to an ambient low humidity condition, the DC current detected in the segments B1 or B2 in which the charging roller is constant-DC voltage controlled decreases. However, since the image forming surface area of the drum 1 is charged by the charging roller 2 being constant-DC voltage controlled using the voltage corrected to be higher in response to the then detected DC current, and the image forming operation is carried out using the exposure based on the corrected lamp voltage, the charge potential of the drum 1 is stabilized regardless of the resistance changes of the charging roller 2 caused by the environment.

Figure 15:
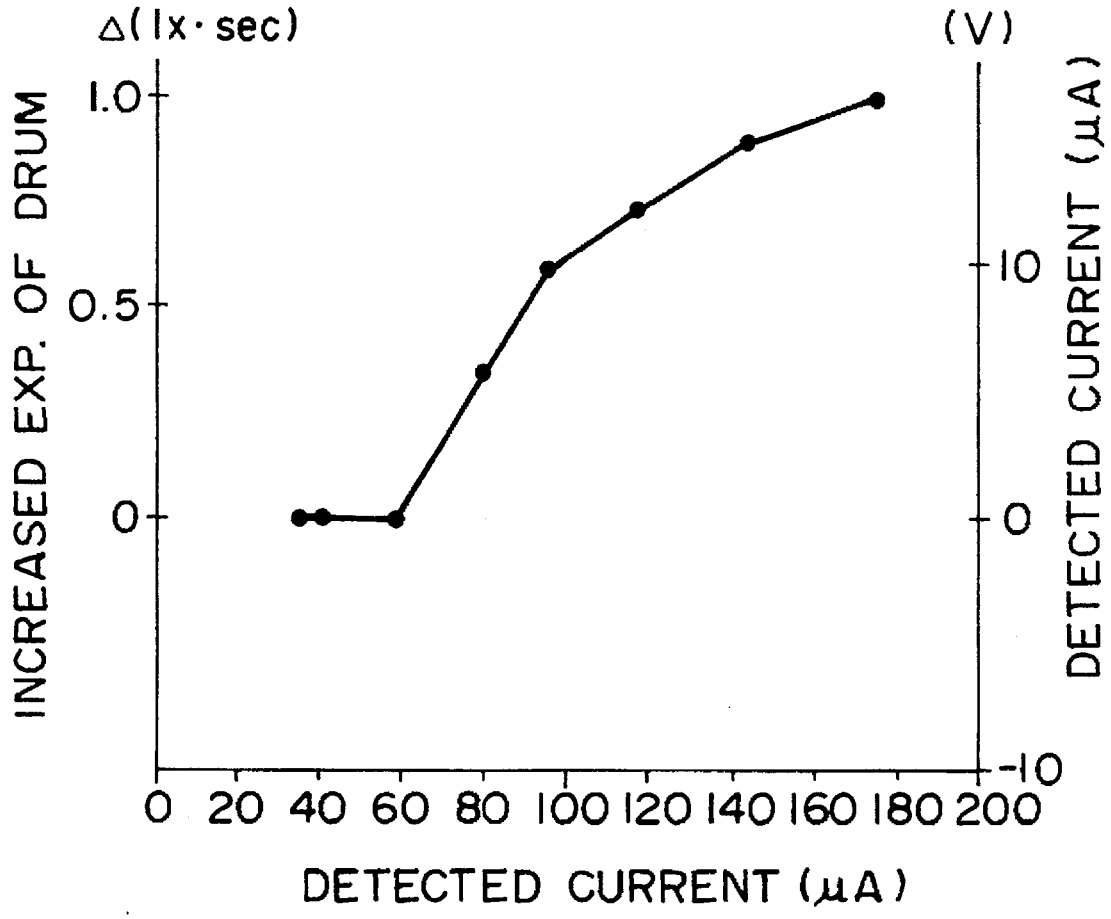
FIG. 15 is a graph showing the relation between the detected current, corrected lamp voltage value, and the amount of increased drum surface exposure.

FIG. 15 is a correlation diagram between the detected current, corrected lamp voltage output, and increased amount of the exposure light on the drum surface.

Figure 16A:
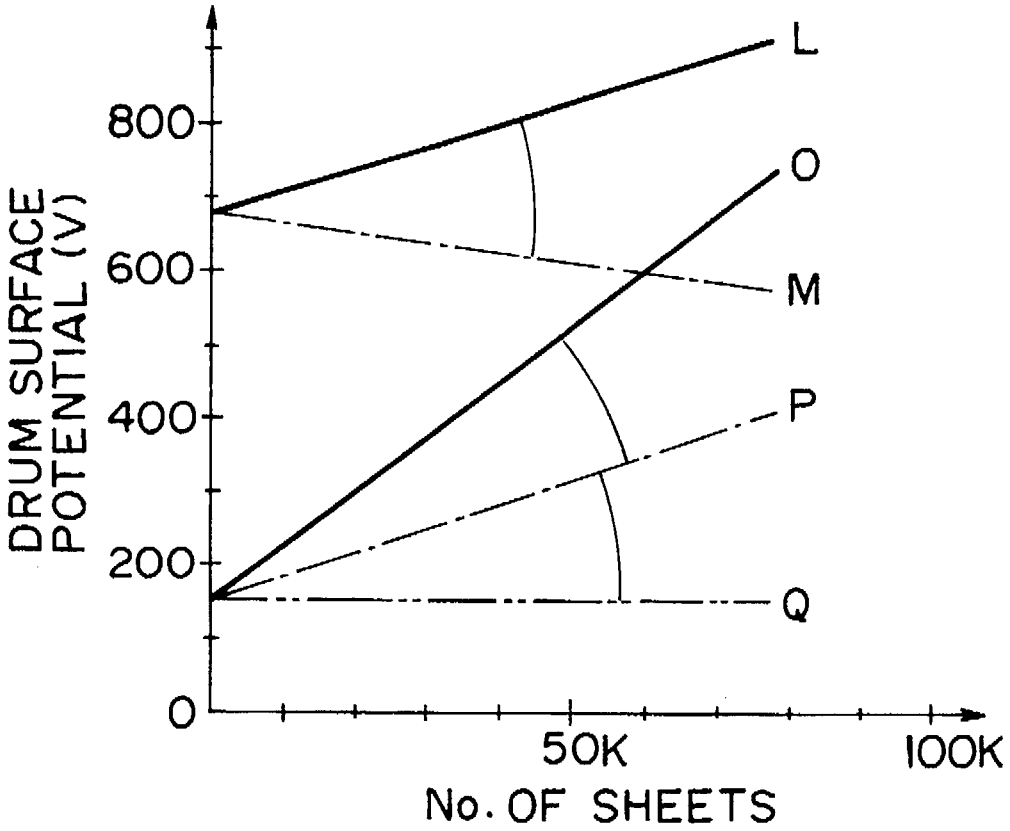
FIGS. 16A and 16B are graphs showing the results of experiments in which corrections are made.
Figure 16B:
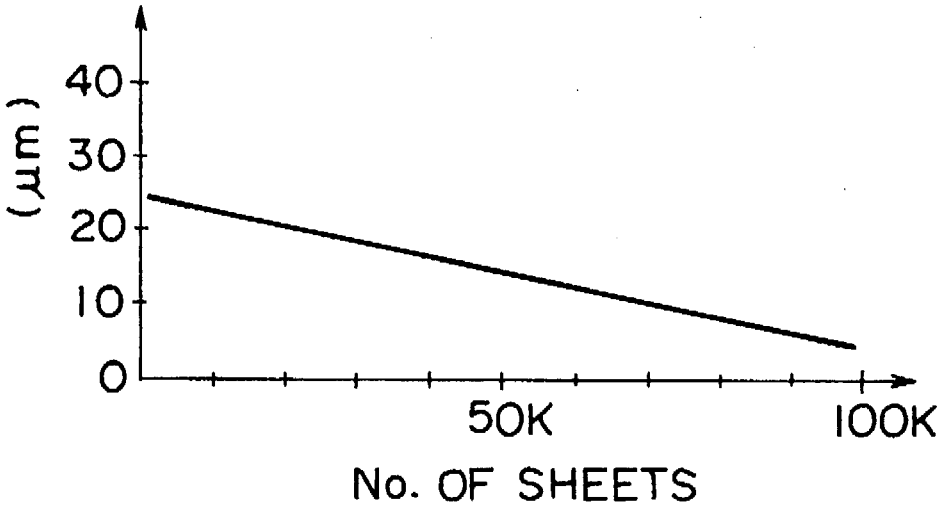

FIGS. 16A and 16B show the results of the experiments in which the above corrections were made. The sheet count as the image formation count is plotted on the axis of abscissa, so that the potential changes on the drum surface are displayed in relation to the image formation count. When a specific constant voltage is applied to the charging member regardless of the reduction in the photosensitive material film thickness, the surface potential changes are shown by L for the dark area potential $V_D$, and O for the light area potential. If the amount of DC current is detected during the application of the constant voltage to the charging roller, and the charging member is constant-voltage controlled using the voltage corrected in response to this detected current, the drum surface potential can be controlled to decrease at the same rate as shown by M and P, respectively, even if the print count increases.

Further, as the detected amount of current increases, the voltage applied to the image exposure lamp is increased so that the amount of exposure is increased, the light portion potential decreases to Q, resulting in that the dark portion potential $V_D$ becomes M and the light portion potential $V_L$ becomes Q. At this time, if the dark portion potential $V_D$ is controlled in the downward direction, the rate at which the light portion potential $V_L$ increases can be suppressed, whereby the range of exposure variation can be narrowed.

In other words, it is determined that the thickness of the photosensitive film has decreased, compared to its initial thickness, in proportion to the increase in the detected current over a predetermined value. As indicated by M in FIG. 16A, the voltage applied to the charging member is determined to be corrected so that the dark area potential decreases as the thickness of the photosensitive film decreases. The photosensitive material area where the image is formed is charged to the potential $V_D$ by the charging roller being constant-DC voltage controlled using this corrected voltage. Also, as shown in FIG. 15, when the detected current is below a predetermined value (60 μA), the amount of light from the lamp is kept constant. In other words, it is judged that no change has occurred in the thickness of the photosensitive material while the resistance of the charging roller was affected by the ambient change.

The photosensitive material 1 and charging roller 2 used in this experiment was the same as the one described regarding the preceding embodiment.

Next, another sequence for the apparatus will be described.

Figure 17:
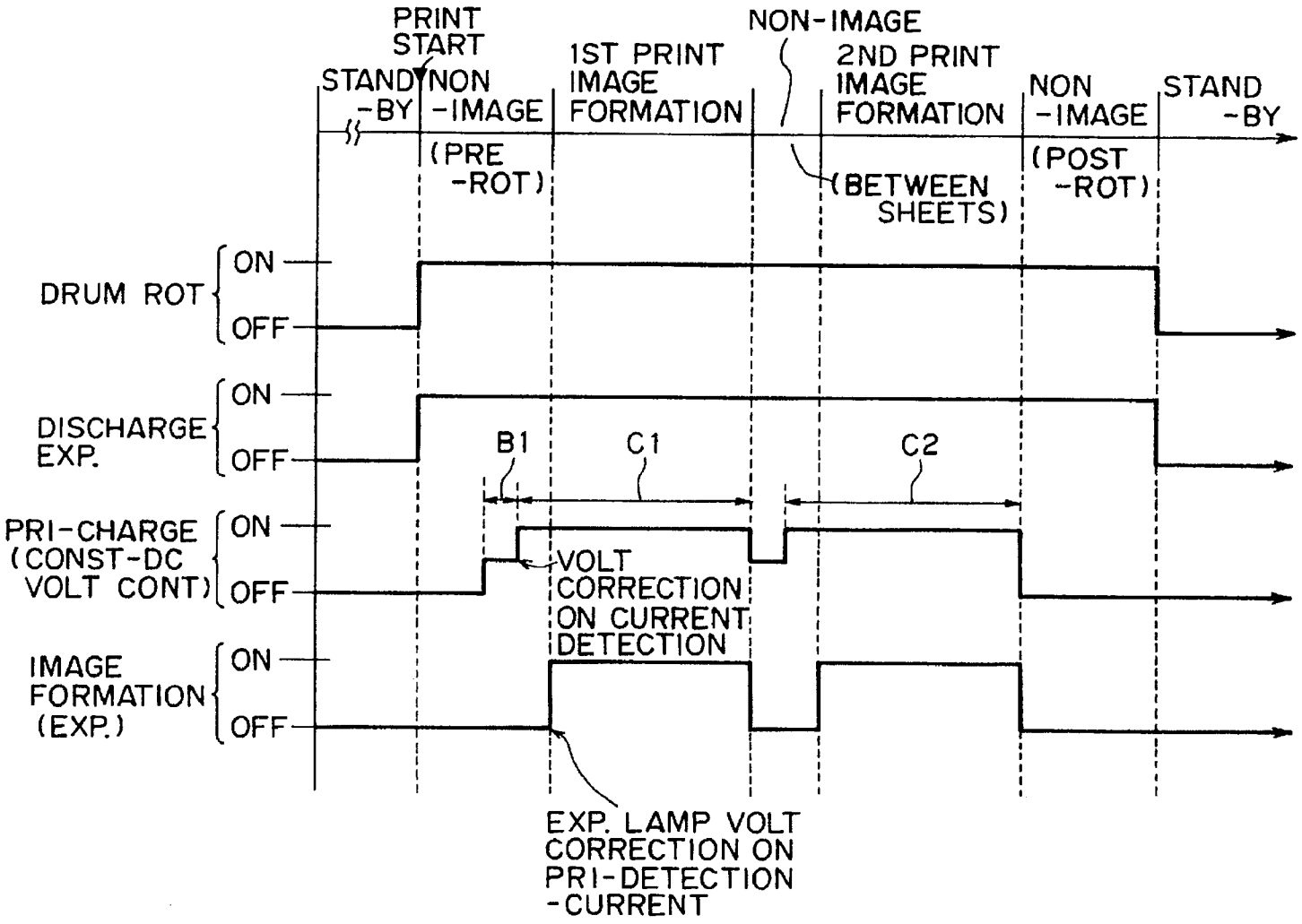
FIG. 17 is a sequence diagram for the sixth embodiment.

The sequence in FIG. 17 is comparable to the one in FIG. 14, except that the constant-DC voltage control of the charging roller and DC current detection are carried out only in the segment B1 during the pre-rotation of the drum 1, and are not carried out during the sheet absent period between the consecutive prints.

That is, during a single session of consecutive image formation, the constant-DC voltage control of the charging roller and the correction of the voltage applied to the exposure lamp 22 are carried out in response to the DC current detected in the segment B1.

However, the detected DC current, corrected primary voltage, and corrected lamp voltage are re-corrected in the segment B1 of the drum pre-rotation period at the beginning of the next printing session.

Next, another sequence for the apparatus is described.

Figure 18:
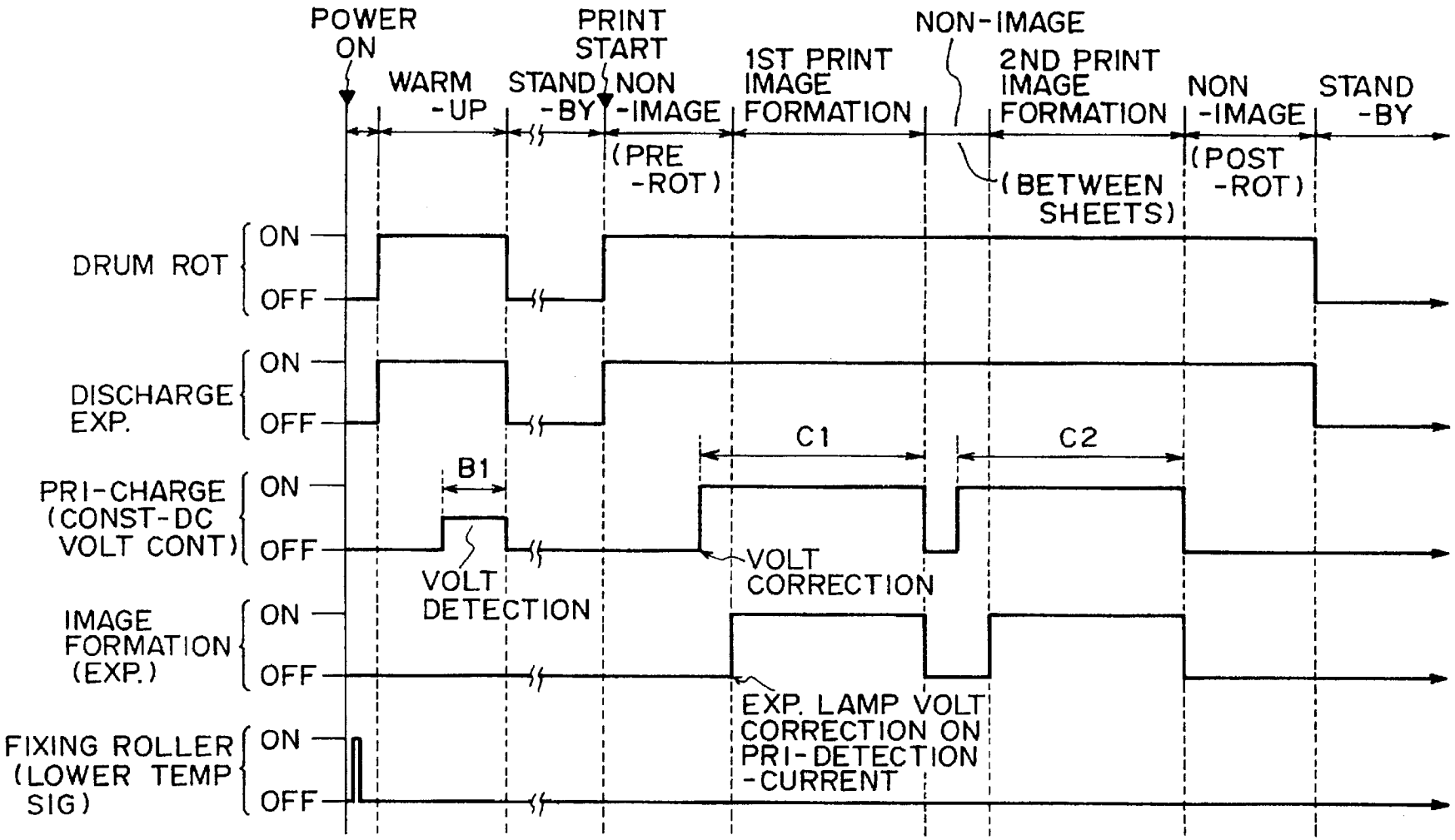
FIG. 18 is a sequence diagram for the seventh embodiment.

In the sequence given in FIG. 18, the constant-DC current control of the charging roller 2 and DC voltage detection are carried out immediately after the power to the image forming apparatus is turned on, that is, during the apparatus warmup period for increase the temperature of the image fixing apparatus.

After the warmup is completed, the charge removing exposure and the drum rotation are stopped, and the apparatus enters the standby state.

After a print start signal is inputted, the primary charge bias of the charging roller 2 during each image formation cycle is constant-DC voltage controlled using the primary voltage corrected in response to the DC voltage detected during the above mentioned drum pre-rotation period, with the charging roller being under the constant-DC current control, and also, the voltage of the exposure lamp 22 is corrected to carry out the image forming operation.

Here, as the detected DC voltage becomes smaller than a predetermined value, it is determined that the thickness of the photosensitive film has decreased compared to its initial value, whereby the voltage to be applied to the charging roller is corrected to be smaller. Then, the photosensitive material surface area where the image is formed is charged to $V_D$ by the charging roller being constant-voltage controlled using this corrected voltage. Also, the voltage to be applied to the exposure lamp 22 is corrected to be larger with the decrease of the detected voltage beyond a predetermined value, whereby the amount of photosensitive material exposure is increased.

The above mentioned detected voltage, corrected primary voltage, corrected lamp voltage are retained till the power to the printer is cut off.

Also, as described regarding the preceding embodiment, the timing for this detection may be scheduled to be once a day, that is, only once at the beginning of the work day schedule (or "first in the morning"), which will be effective for stabilizing the image density. For example, even if the power source of the apparatus is turned off only for a short time to take care of a paper jam in the apparatus, the current detection is carried out again when the power is turned on next time, and the voltage corrected previously is re-corrected. In other words, there is a chance that the values of the corrected voltage (corrected primary voltage and corrected lamp voltage) before the power source is turned off and after it is turned off varies depending on the voltage detection accuracy, and even if the changes in the corrected voltages are ever so slight, an apparatus operator can detect a substantial difference if the changes occur in a short time, resetting thereby the density setting value for the image forming operation.

Conversely, in order to improve the operational performance of the image forming apparatus, the processes of the constant-DC current control of the charging roller, voltage detection therein, and the constant-voltage control using the corrected voltage, and the voltage correction for the exposure lamp 22 are carried out only once at the time when the apparatus is started up at the beginning of the work day schedule, and this corrected voltage for the constant-voltage control and corrected exposure lamp voltage are retained for the day.

As a result of practical application tests, a method effective as a means for determining whether the apparatus is in the "first in the morning" condition was found to be a method in which the apparatus was determined to be in the "first in the morning" condition if the detected temperature of the fixing roller in the fixing apparatus was below a specific temperature at the time when the power to the image forming apparatus was turned on. Here, it was effective to choose this specific temperature to be in a range between 30° C. to 130° C., and in particular, it was most effective if it was selected to be approximately 100° C.

When the DC voltage is detected only once, the following problem occurs if the charging roller 2 as the charging member displays non-uniform resistance in the peripheral direction at the very moment when this single DC voltage detection is carried out; if the voltage is detected corresponding to the portion having a lower resistance, a higher voltage is detected, whereby the voltage value after correction is lower and the lamp voltage after correction is higher, with the result that the charge potential is excessively low. In the case of normal development, the image density is reduced, and in the case of reverse development, the image density is increased, displaying image flaws such as fogging.

Figure 19:
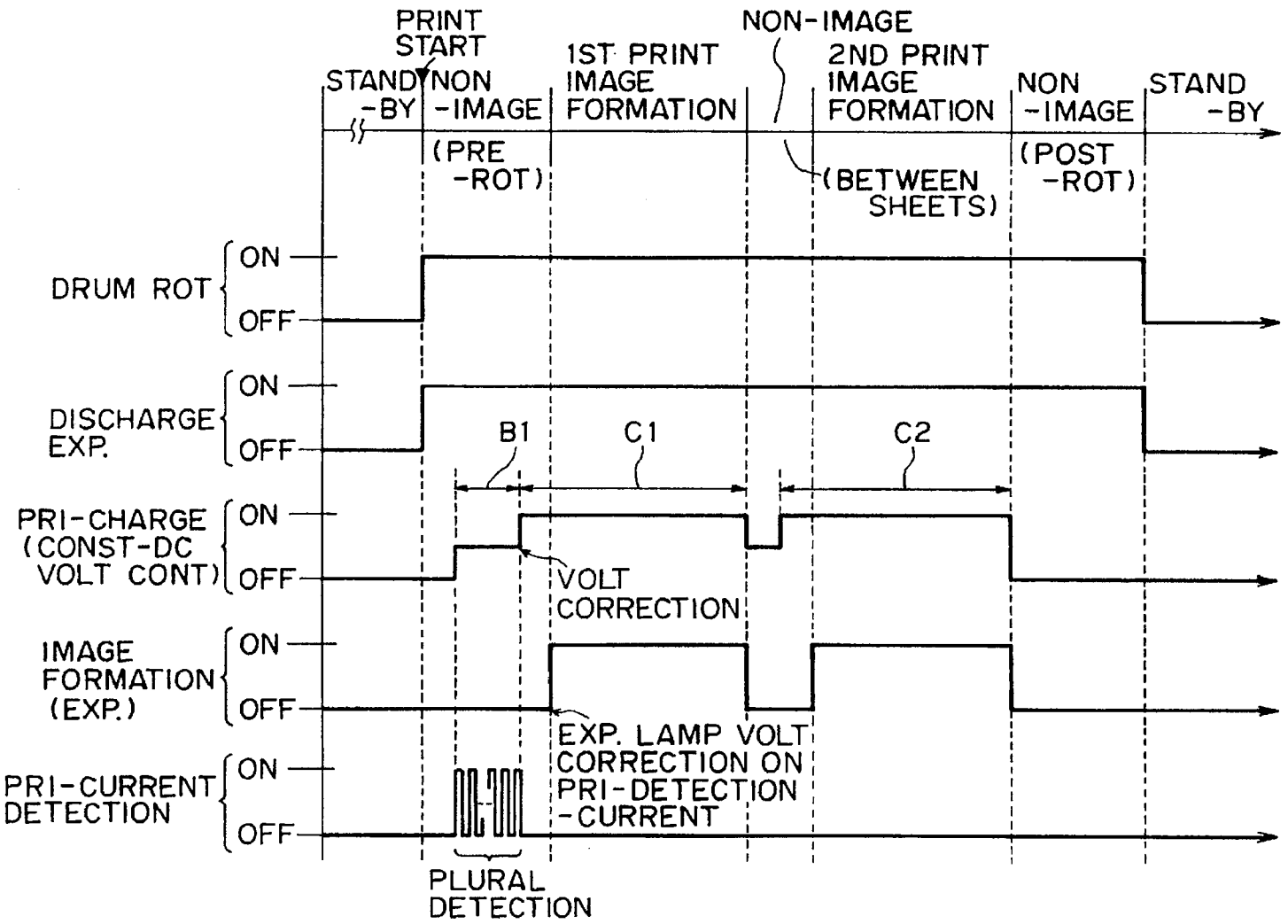
FIG. 19 is a sequence diagram for the eighth embodiment.
Figure 20:
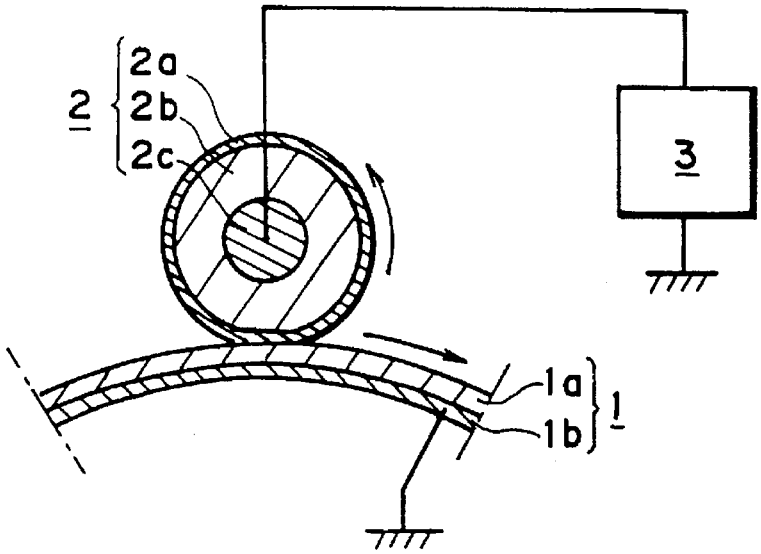
FIG. 20 PRIOR ART
FIG. 20 is a schematic view of an example of the contact charging apparatus.

In this embodiment, in order to solve the problem of image density variance deriving from the difference in the detected voltage in the peripheral direction of the charging roller, the DC voltage detection is carried out a number of times during the period under the constant-DC current control as the sequence in FIG. 19 shows, and the corresponding number of detected DC voltage values are added or integrated to obtain their average value. During the image forming period, the charging roller 2 is constant-voltage controlled using a voltage corrected in response to the average of the detected voltage values, and the voltage applied to the exposure lamp 22 is corrected in the same manner.

Further, methods other than the above one are also acceptable. For example, the maximum and minimum values may be eliminated from the number of detected DC voltage values.

According to the above described methods, a stable value can be obtained for the detected voltage, whereby stable corrected voltages (corrected primary voltage and corrected lamp voltage) can be obtained, even when resistive non-uniformity is displayed in the peripheral direction of the charging roller 2.

According to the above embodiment, even if the capacity of the photosensitive material changes as the image formation count increases, whereby the thickness of the photosensitive material is reduced, an optimally corrected voltage can be applied to the charging member, and an optimal exposure is given by the then optimally corrected lamp voltage, since the voltage-current characteristic reflecting the capacity corresponding to the then thickness of the photosensitive material is detected each time the change occurs.

As a method for implementing the above concept, the charging member is constant-DC current controlled during the non-imaging period, and then, during the image forming period, the charging member is constant-voltage controlled using the voltage corrected in response to the then detected voltage, and the image exposure lamp voltage is also corrected for controlling the amount of exposure.

In other words, as the thickness of the photosensitive material decreases, the amount of voltage detected during the non-image forming period under the constant-current control decreases, but since the voltage to be applied to the charging member during the image forming period is corrected in response to the above decreased voltage amount, and the lamp voltage is also corrected in response to the above increased voltage amount, the charging process is carried out in the optimal condition, whereby the image forming operation is carried out in the optimal condition.

Further, when the resistance value increases because of the changes in the resistive layer of the charging member caused by the ambient humidity changes or extend usage, the detected voltage amount increases, but since the voltage applied during the image forming period is corrected to be higher in response to the above increased voltage amount, the lamp voltage is corrected to be lower or kept constant, the insufficient charging or fogging is eliminated, and a sufficient image density and image quality are always obtained.

Figure 22A:
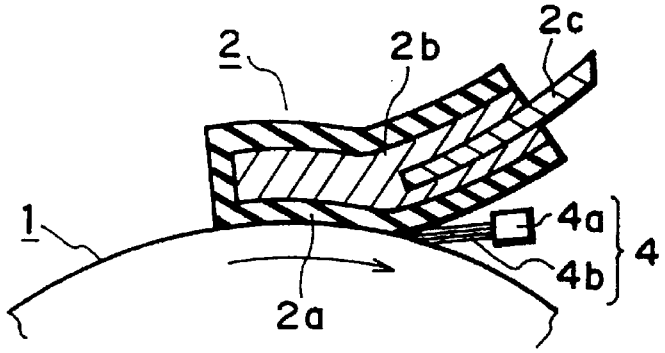
FIGS. 22A and 22B are cross-sectional views of the contact type charging members.
Figure 22B:
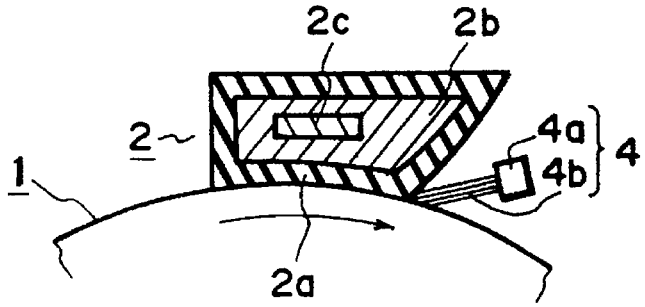
Figure 21:
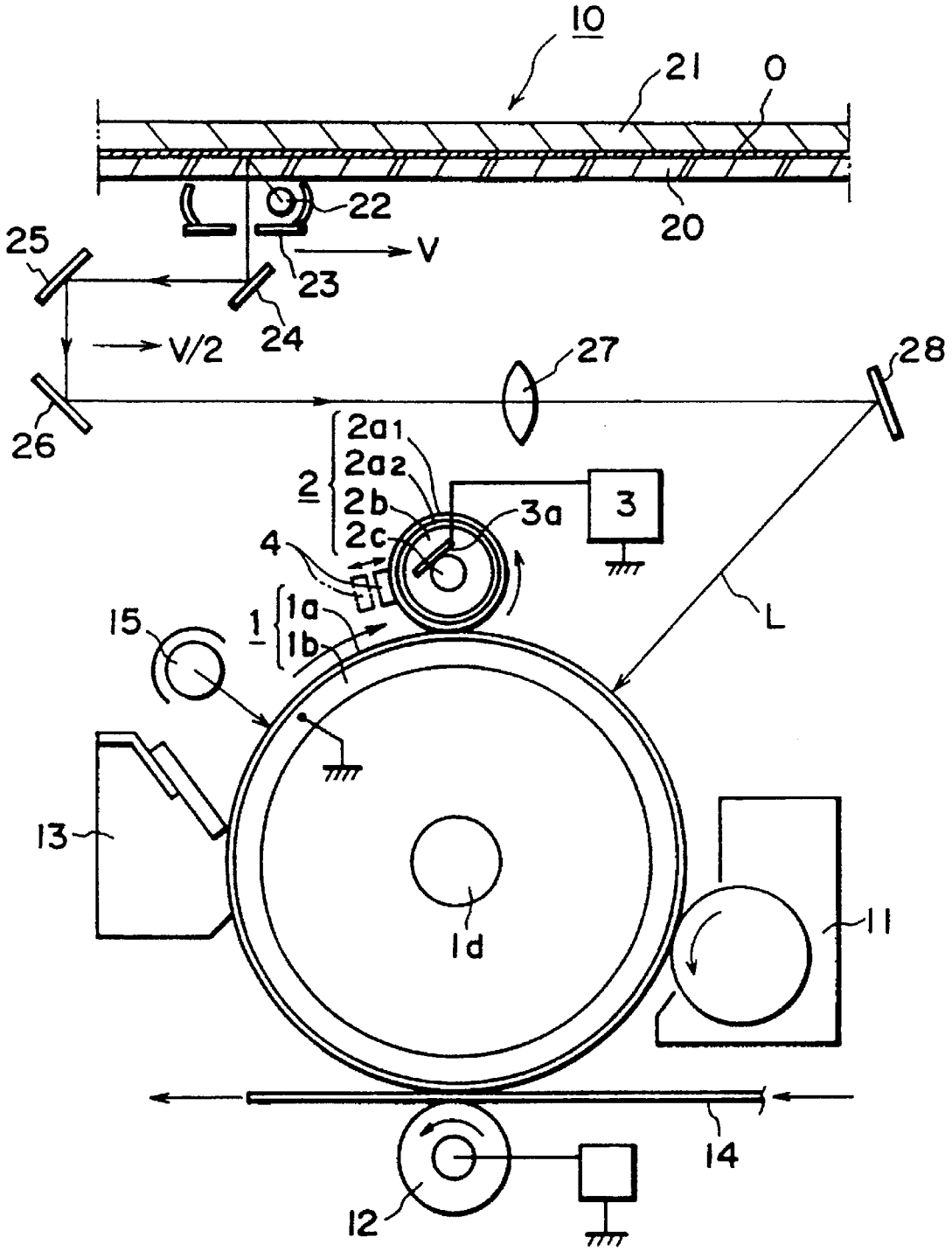
FIG. 21 is a schematic view of a preferred embodiment, depicting the essential structure of the image forming apparatus.

As stated above, when the voltage-current characteristic between the charging member and the photosensitive material is detected on the basis of the current detected while the charging member is under the constant-voltage control, it is desirable for the detection variance caused by the contamination on the charging member to be absent. In order to implement such a state, it is preferred for the apparatus to be provided with a cleaning member for the charging member, as shown in FIGS. 22A and 22B. The cleaning member 4 is a pad made of sponge or micro fiber (trade name: EKUSEINU, Toray, Co., Ltd.), and is controlled by an unshown driving means to come in contact with or to be separated from the charging roller 2.

In the case of the embodiments shown in FIGS. 22A and 22B, the cleaning member 4 is a cleaning brush comprising a supporting base 4*a* and a brush 4*b*, and is moved by the unshown driving means in the longitudinal direction of the photosensitive material 1, sliding along and cleaning thereby the micro gap portion of the nip between the charging blade 2 or charging block 2, and the photosensitive material 1.

Figure 23:
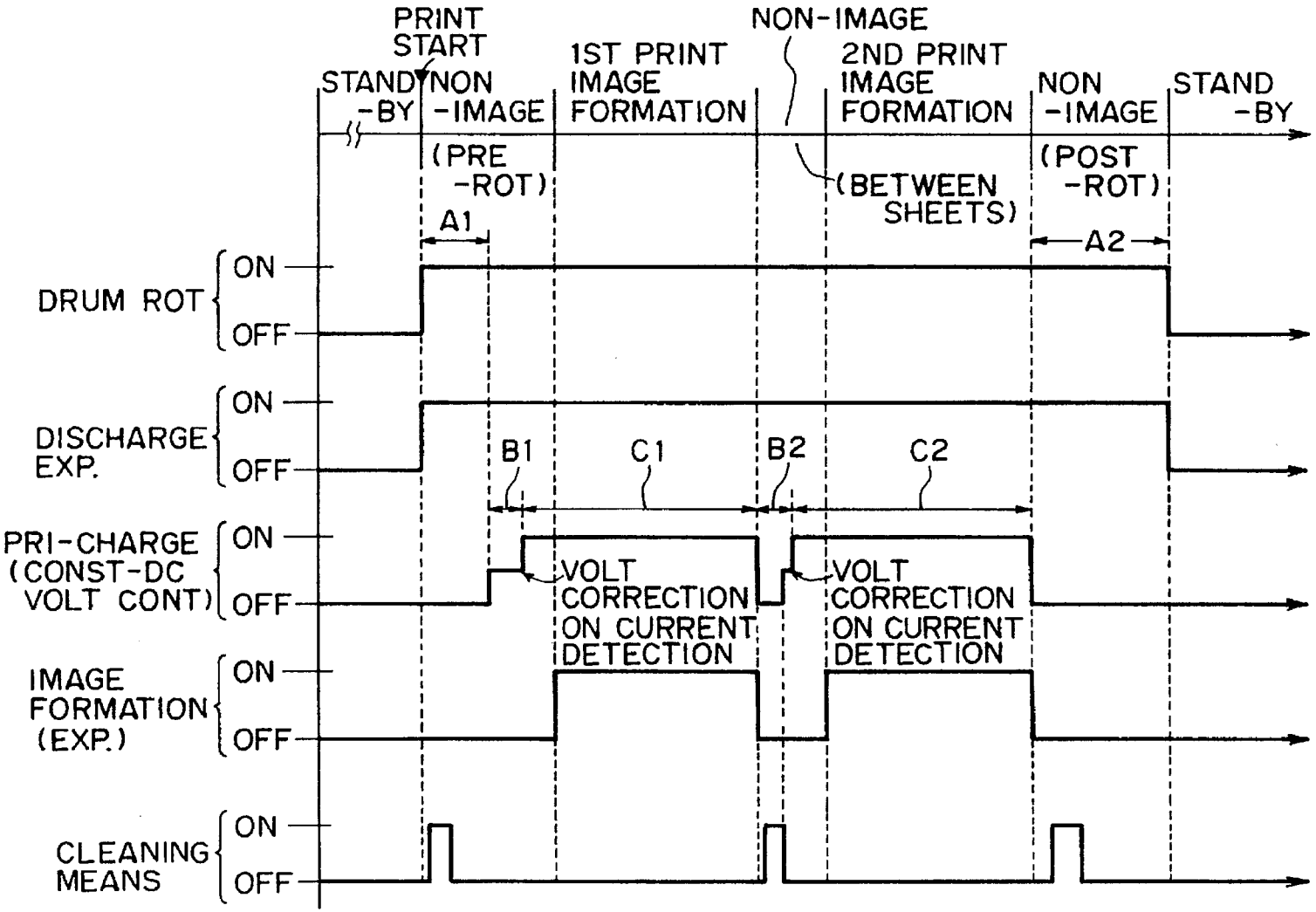
FIGS. 23–26 are sequence diagrams for the image forming apparatus.

FIG. 23 shows a sequence diagram for controlling the cleaning member 4 to make contact with or to be separated from the charging member.

The cleaning member 4 comes in contact with the charging roller at least in the segment A1 during the drum pre-rotation period ranging from the time when the print start signal is inputted till the time when the charging by the charging roller begins for the image forming operation, sweeping clean thereby the charging roller 2 as the charging roller rotates.

The charging roller 2 is satisfactorily cleaned as it rotates one to five times, and then, the cleaning member 4 is separated from the charging roller 2.

With the above described structure in place, even when the surface of the charging roller 2 is soiled through extended usage, and in addition, the photosensitive film becomes thin by being shaved, the DC current detected in the segment B1 or B2, in which the charging roller 2 facing the image forming surface area is constant-DC voltage controlled, remains precisely and satisfactorily high and uniform, and therefore, the image forming surface area of the drum 1 is charged for the image forming operation, by the charging roller 2 being constant-DC voltage controlled using the voltage corrected to be lower in response to this detected DC current.

Thus, the current is detected after the cleaning operation of the charging roller, which may have been soiled, and therefore, the voltage control accuracy is improved, providing a stable voltage, in other words, a stable image.

Figure 24:
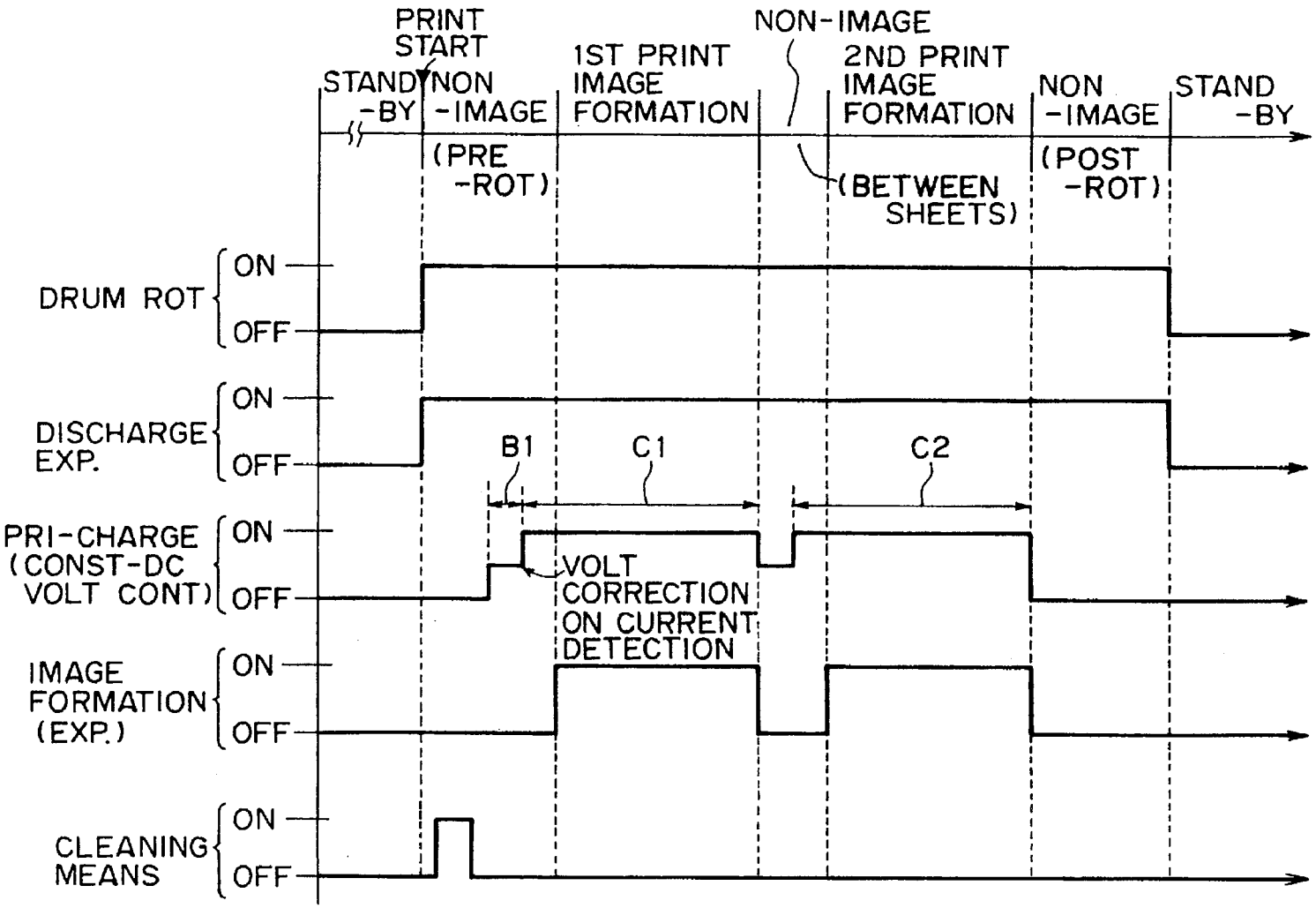

Next, FIG. 24 shows another sequence making the cleaning member 4 to come in contact with or to be moved away from the charging member 2.

The sequence in FIG. 24 is comparable to the one in FIG. 23, except that the DC current detection with the charging roller 2 being under the constant-DC voltage control and the cleaning of the charging roller 2 are carried out only in the segment B1 during the drum 1 pre-rotation period, and are not carried out in the sheet absent periods between the consecutive printing cycles.

Figure 25:
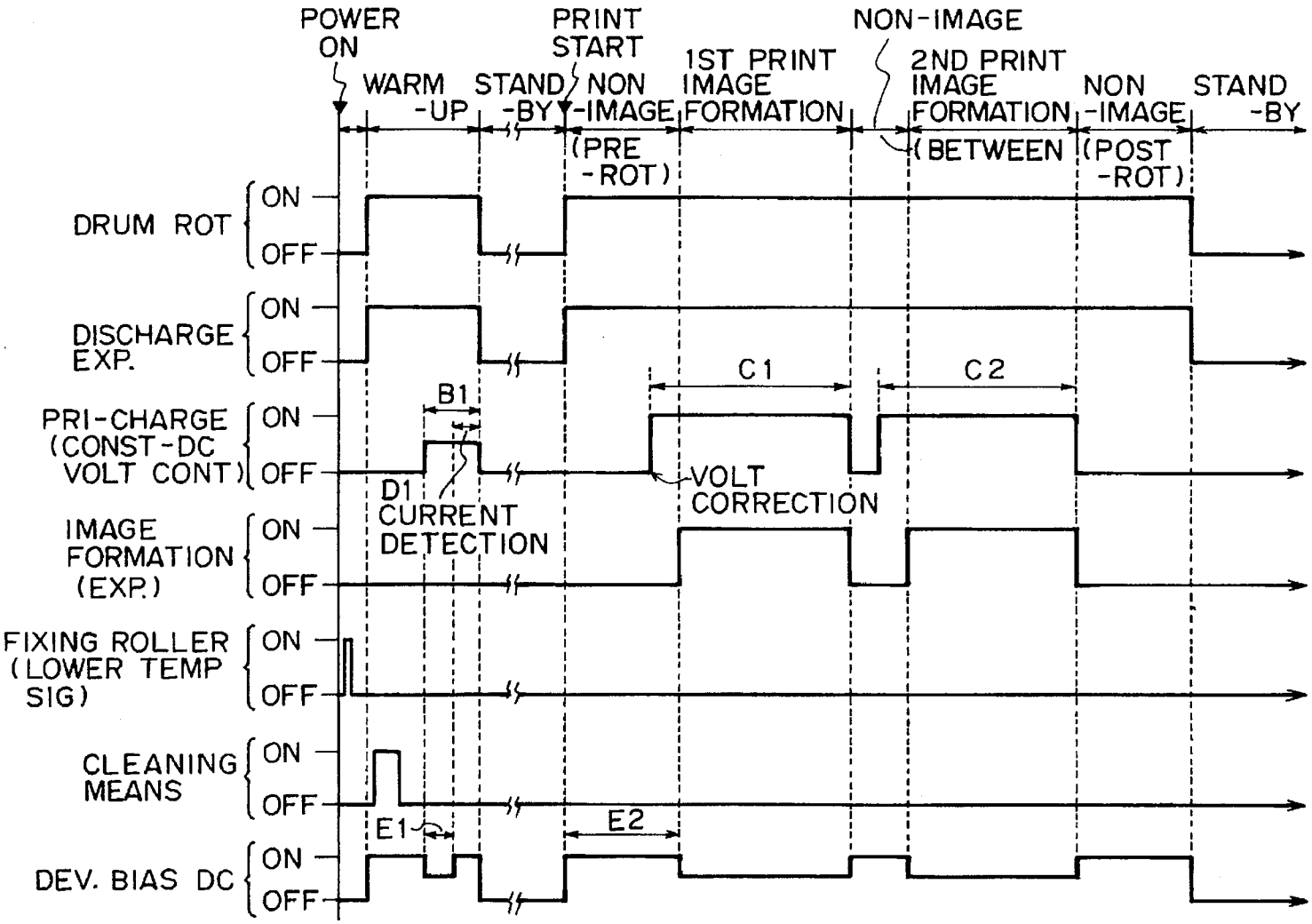

With this arrangement, the images on the a group of consecutive prints do not change from print to print, being stabilized, In the sequence shown in FIG. 25, during the apparatus warmup period immediately after the power to the image forming apparatus is turned on, first, the charging roller 2 is cleaned, and then, the charging roller 2 is constant-DC voltage controlled in the segment B1, the DC bias to be applied to the development sleeve is set to E1 the same bias DC as the one in the image forming period, in response to the drum surface potential, then the toner image is formed on the drum, and in the segment D1, the DC current is detected. Otherwise, the developing bias is non-image bias E2.

The timing for performing this cleaning, toner image formation, and current detection may be scheduled to be substantially once a day, that is, only once at the beginning of the work day schedule (or "first in the morning"), which will be effective for stabilizing the image density. For example, even if the power source of the apparatus is turned off for a short time to take care of a paper jam in the apparatus, the current detection is carried out again when the power is turned next time, and the corrected voltage is re-corrected. In other words, there is a chance that the values of the corrected voltage before the power source is turned off and after it is turned off varies depending on the current detection accuracy, and even if the corrected voltage changes ever so slightly, an apparatus operator can detect a substantial difference if the change occurs in a short time, resetting thereby the density setting value for the image formation.

Contrarily, in order to improve the operational performance of the image forming apparatus, the sequence comprising cleaning the charging roller, applying the constant-voltage to the charging roller, forming a toner image on the drum, detecting the current, and controlling the voltage using the corrected voltage is carried out only once at the time when the apparatus is started up at the beginning of the work day schedule, and this corrected constant-voltage is retained for the day.

Further, since the foreign matter or paper powder adhering to the drum surface after extended usage are removed by means of forming a toner image on the drum during the "first in the morning" operation, high quality images can be stably offered for a long time. If the current flowing through the peripheral surface area of the charging roller 2 where the resistance is high due to soiling is measured, a low current is detected, which leads to a higher corrected voltage, increasing the charge potential. This may cause imaging flaws such as a foggy image.

Figure 26:
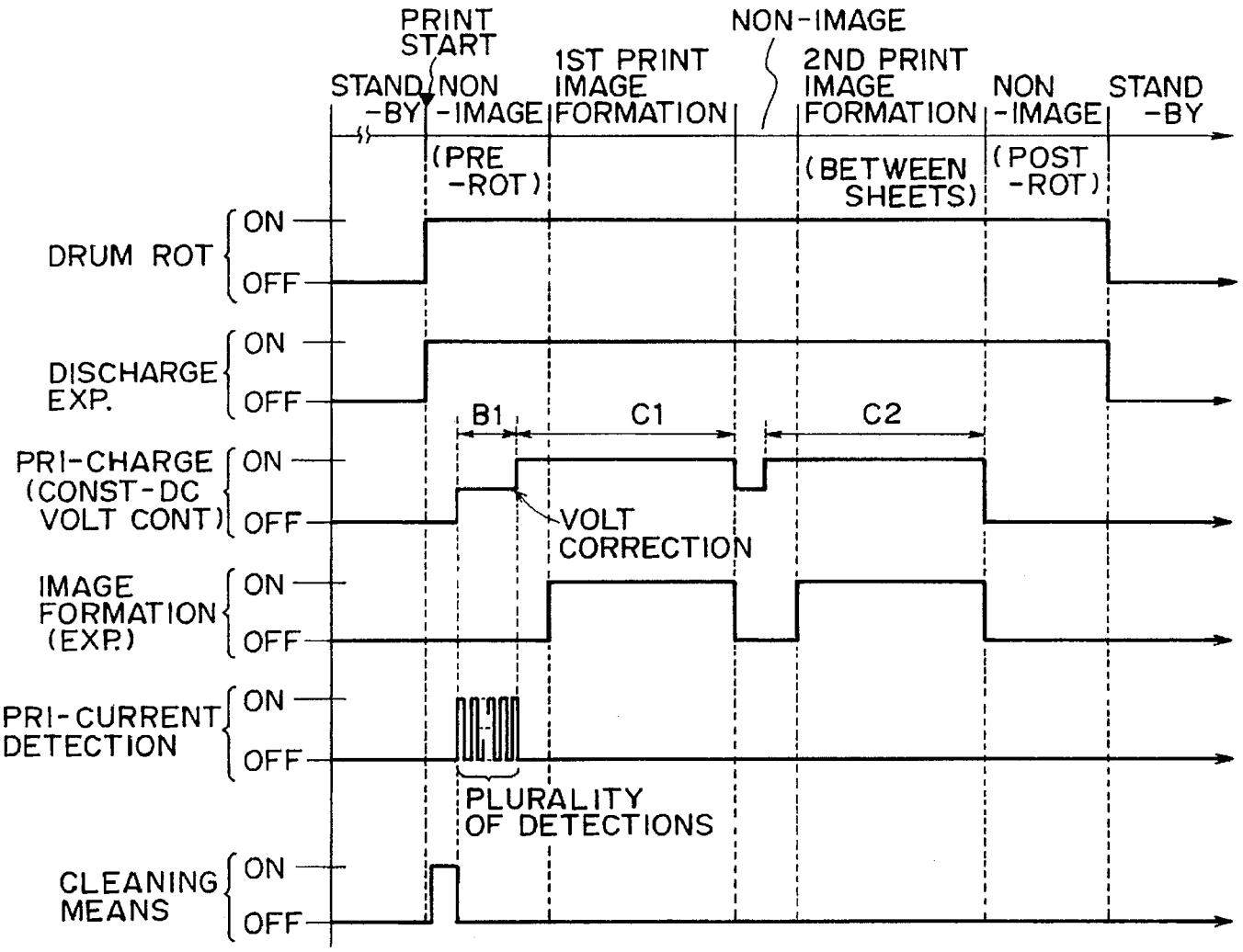

In order to solve the problem of image density variance deriving from the contamination of the charging roller, or the difference in the detected current in the peripheral direction of the charging roller, the DC current detection is carried out a number of times while the charging member 2 is under the constant-DC voltage control, as the sequence in FIG. 26 shows, and the corresponding number of detected DC current values are added or integrated to obtain their average value. During the image forming period, the charging roller 2 is constant-voltage controlled using a voltage corrected in response to the average of the detected current values. Further, methods other than the above one are also acceptable. For example, the maximum and minimum values may be eliminated from the number of detected DC current values.

According to the above embodiment, even if the thickness of the photosensitive material is reduced as the image formation count increases, whereby the capacity of the photosensitive material changes, an optimally corrected voltage can be applied to the charging member by means of detecting, each time after the charging member 2 is cleaned, the voltage-current characteristics reflecting the capacity which corresponds to the then thickness of the photosensitive material.

When the resistance of the charging roller 2 increases because the resistive layer displays changes caused by factors such as ambient humidity changes or extended usage, or because the charging member is soiled by the toner, the detected DC current is reduced, whereby correction for increasing the voltage is made to the voltage to be applied during the image formation. Therefore, no insufficient charge is given, and a satisfactory image density and image quality can be always obtained.

In the above embodiment, when the photosensitive material surface area serving as the image forming area is charged by the charging member, the charging member is under the constant-voltage control. However, the charging member may be constant-current controlled, wherein the current supplied to the charging member is kept constant. When the constant-current control is carried out, the photosensitive material potential is reduced with the amount of decrease in the photosensitive material film thickness compared to the initial thickness thereof. Therefore, if the constant current value to be used for constant-current control is increased with the decrease in the photosensitive material film thickness, the photosensitive material potential can be kept constant.

Further, when the voltage-current characteristic between the photosensitive material and charging member is detected with reference to the capacity of the photosensitive material which corresponds to the thickness thereof, it is preferable for the charging member to be constant-voltage controlled rather than to be constant-current controlled. This is because when constant-current control is carried out, there is a chance that if a pin hole is present, almost the entire current flows through the pin hole, and the power source may break down. In such a case, it becomes impossible to detect accurately the above mentioned voltage-current characteristic. Also, when the constant-current control is carried out, the range of the voltage detected with reference to the photosensitive material film thickness becomes excessively wide, and therefore, the detecting apparatus is likely to become large and expensive. Thus, in order to detect the above mentioned voltage-current characteristic, it is preferable for the charging member to be constant-voltage controlled, and therefore, it is also preferable for the charging member to be constant-voltage controlled while the photosensitive material is charged for image formation. This is because it is not necessary to provide both a constant-current circuit and constant-voltage circuit.

What is claimed is:

1. An image forming apparatus comprising:

a movable image bearing member having a photosensitive layer;

image forming means for forming an image on said image bearing member, said image forming means including a contact charging member, contactable to said image bearing member, for charging said image bearing member, and light radiating means for radiating light on said image bearing member;

detecting means for detecting a voltage applied to said charging member while said charging member is constant-current controlled using a predetermined current value;

controlling means for controlling, in response to a detection result of said detecting means, an amount of light radiated from said light radiating means to be increased with a decrease in the detected voltage decreasing beyond a predetermined value.

2. An image forming apparatus comprising:

a movable image bearing member having a photosensitive layer;

image forming means for forming an image on said image bearing member, said image forming means including a contact charging member, contactable to said image bearing member, for charging said image bearing member for image formation, and light radiating means for radiating light on said image bearing member;

detecting means for detecting a current flowing through said charging member while said charging member is constant-voltage controlled using a predetermined voltage value;

controlling means for controlling, in response to a detection result of said detecting means, an amount of light radiated from said light radiating means to be increased with increase in the detected current increasing beyond a predetermined value;

wherein a voltage applied to said charging member during image formation is reduced with increase in the detected current increasing beyond a predetermined value.

3. An image forming apparatus according to claim 2, wherein said charging member is constant-voltage controlled during image formation.

4. An image forming apparatus comprising:

a movable image bearing member having a photosensitive layer;

image forming means for forming an image on said image bearing member, said image forming means including a contact charging member, contactable to said image bearing member, for charging said image bearing member for image formation, and light radiating means for radiating light on said image bearing member;

detecting means for detecting a current flowing through said charging member while said charging member is constant-voltage controlled using a predetermined voltage value;

controlling means for controlling, in response to a detection result of said detecting means, an amount of light radiated from said light radiating means to be increased with increase in the detected current increasing beyond a predetermined value;

wherein the current applied to said charging member during the image formation is increased with increase in the detected current increasing beyond a predetermined value.

5. An image forming apparatus according to claim 4, wherein said charging member is constant-current controlled during image formation.

6. An apparatus according to claims 2, or 4, wherein said detecting means is disposed at a voltage application side of said charging member.

7. An image forming apparatus comprising:

a movable image bearing member having a photosensitive layer;

image forming means for forming an image on said image bearing member, said image forming means including a contact charging member, contactable to said image bearing member, for charging said image bearing member for image formation, and light radiating means for radiating light on said image bearing member;

detecting means for detecting a voltage applied to said charging member while said charging member is constant-current controlled using a predetermined current value;

controlling means for controlling, in response to a detection result of said detecting means, an amount of light radiated from said light radiating means to be increased with decrease in the detected voltage decreasing beyond a predetermined value;

wherein a current applied to said charging member during the image formation is reduced with decrease in the detected voltage decreasing beyond a predetermined value.

8. An image forming apparatus according to claim 7, wherein said charging member is constant-voltage controlled during image formation.

9. An image forming apparatus comprising:

a movable image bearing member having a photosensitive layer;

image forming means for forming an image on said image bearing member, said image forming means including a contact charging member, contactable to said image bearing member, for charging said image bearing member for image formation, and light radiating means for radiating light on said image bearing member;

detecting means for detecting a voltage applied to said charging member while said charging member is constant-current controlled using a predetermined current value;

controlling means for controlling, in response to a detecting result of said detecting means, an amount of light radiated from said light radiating means to be increased with decrease in the detected voltage decreasing beyond a predetermined value;

wherein a current applied to said charging member during the image formation is increased with decrease in the detected voltage decreasing beyond a predetermined value.

10. An image forming apparatus according to claim 9, wherein said charging member is constant-current controlled during the image formation.

11. An image forming apparatus according to claims 1, 2, 4, 7 or 9, wherein said light radiating means exposes said image bearing member, for image formation.

12. An image forming apparatus according to claims 1, 2, 4, 7, or 9, wherein a detecting operation of said detecting means is carried out before said charging member charges said image bearing member, for image formation.

13. An image forming apparatus according to claim 12, wherein a detecting operation of said detecting means is carried out during a warmup period of said apparatus.

14. An image forming apparatus according to claims 1, 2, 4, 7, or 9, wherein said apparatus further comprises a cleaning member for cleaning said charging member, and said cleaning member cleans said charging member before detecting operation of said detecting means.

15. An image forming apparatus comprising:

a movable image bearing member having a photosensitive layer;

image forming means for forming an image on said image bearing member, said image forming means including a contact charging member contactable to said image bearing member for charging said image bearing member, and light radiating means for radiating light on said image bearing member;

detecting means for detecting a current flowing through said charging member during a constant-voltage control period n which a predetermined voltage is applied to said charging member; and controlling means for controlling an amount of light radiated from said light radiating means to said image bearing member, such that in accordance with a result of the detection, the amount of the light increases with increase of the detected current beyond a predetermined level, and the amount of the light is constant below the predetermined level of the detected current.

16. An image forming apparatus according to claim 15, wherein said charging member is capable of charging said image bearing member, for image forming operation, and a voltage applied to said charging member during the image forming period is decreased with an increase of said detected current exceeding a predetermined value.

17. An image forming apparatus according to claim 16, wherein said charging member is constant-voltage controlled during an image forming period.

18. An image forming apparatus according to claim 16, wherein said light radiating means exposes an image on said image bearing member.

19. An image forming apparatus according to claim 15, wherein said light radiating means exposes an image on said image bearing member.

20. An image forming apparatus as in one of claims 15 to 18, wherein said charging member is capable of being placed in contact with said image bearing member.

21. An image forming apparatus according to either claim 15 or 16, wherein a detecting operation of said detecting means is carried out before said charging member charges said image bearing member, for an image forming operation.

22. An image forming apparatus according to claim 21, wherein a detecting operation of said detecting means is carried out during a warmup period of said apparatus.

23. An image forming apparatus according to either claim 15 or 16, wherein said apparatus further comprises a cleaning member for cleaning said charging member, and said cleaning member cleans said charging member before a detecting operation of said detecting means.

24. An apparatus according to claims 15 or 16, wherein said detecting means is disposed at a voltage application side of said charging member.

25. An image forming apparatus comprising:

a movable image bearing member, having a photosensitive layer;

image forming means for forming an image on said image bearing member, said image forming means including a charging member for charging said image bearing member;

detecting means for detecting voltage-current characteristic between said charging member and said image bearing member; and controlling means for controlling variably the surface potential of said image bearing member, in response to said detecting means.

26. An image forming apparatus according to claim 25, wherein said detecting means detects a current flowing through said charging member while said charging member is constant-voltage controlled using a predetermined voltage value, and said controlling means decreases the surface potential of said image bearing member with increase of the detected current exceeding a predetermined value.

27. An image forming apparatus according to claim 26, wherein said image forming means further includes light radiating means for radiating light to said image bearing member, and an amount of light radiated from said light radiating means to said image bearing member is increased with increase of the current exceeding a predetermined value.

28. An image forming apparatus according to claim 27, wherein an amount of light radiated from said light radiating means to said image bearing member is kept constant when the current decreases beyond a predetermined value.

29. An image forming apparatus according to claim 25, wherein said detecting means detects a voltage obtained while said charging member is constant-current controlled using a predetermined current value, and said controlling means decreases the surface potential of said image bearing member with decrease the detected voltage decreasing beyond a predetermined value.

30. An image forming apparatus according to claim 29, wherein said image bearing member comprises a photosensitive layer; said image forming means further includes a light radiating means for radiating light to said image bearing member; and an amount of light radiated from said light radiating means to said image bearing member is increased with decrease of the voltage decreasing beyond a predetermined value.

31. An image forming apparatus according to claim 30, wherein an amount of light radiated from said light radiating means to said image bearing member is kept constant when the voltage increases beyond a predetermined value.

32. An image forming apparatus according to claim 27, 30, 28, or 31, wherein said light radiating means projects an image on said image bearing member.

33. An image forming apparatus as in one of claims 25 to 31, wherein said charging member is capable of being placed in contact with said image bearing member.

34. An image forming apparatus according to any of claims 25, 26, or 29, wherein the surface potential is the charge potential of said image bearing member before a latent image formation.

35. An image forming apparatus according to claim 25, wherein said charging member is capable of charging said image bearing member, for an image forming operation, and a detecting operation of said detecting means is carried out before said charging member charges said image bearing member, for the image forming operation.

36. An image forming apparatus according to claim 35, wherein a detecting operation of said detecting means is carried out during a warmup period of said apparatus.

37. An image forming apparatus according to claim 25, wherein said apparatus further comprises a cleaning member for cleaning said charging member, and said cleaning member cleans said charging member before a detecting operation of said detecting means.

38. An image forming apparatus comprises:

a movable image bearing member;

image forming means for forming an image on said image bearing member, said image forming means including a charging member for charging said image bearing member;

detecting means for detecting current flowing through said charging member while said charging member is constant-voltage controlled using a predetermined voltage value; and controlling means for controlling the surface potential of said image bearing member charged by said charging member, to decrease with increase of the current beyond a predetermined value, in response to said detecting means.

39. An image forming apparatus according to claim 38, wherein said image bearing member comprises a photosensitive layer; said image forming means including light radiating means for radiating light to said image bearing member, and an amount of light radiated from said light radiating means to said image bearing member is increased with increase of the current exceeding a predetermined value.

40. An image forming apparatus according to claim 39, wherein an amount of light radiated from said light radiating means to said image bearing member is kept constant when the current decreases beyond a predetermined value.

41. An image forming apparatus according to claim 38, wherein the surface potential is the charge potential of said image bearing member before a latent image formation.

42. An image forming apparatus according to claim 39 or 40, wherein said light radiating means exposes an image on said image bearing member.

43. An image forming apparatus according to claim 42, wherein the surface potential is the charge potential of said image bearing member before the image exposure of said image bearing member.

44. An image forming apparatus according to claim 38, wherein said charging member is capable of charging said image bearing member, for an image forming operation, and a detecting operation of said detecting means is carried out before said charging member charges said image bearing member, for the image forming operation.

45. An image forming apparatus according to claim 44, wherein the detecting operation of said detecting means is carried out during a warmup period of said apparatus.

46. An image forming apparatus according to claim 38, wherein said controlling means controls said charging member using a constant-voltage corrected to be smaller with increase of the current increasing beyond a predetermined value.

47. An image forming apparatus according to any of claims 38 to 44, or 46, wherein said charging member is capable of being placed in contact with said image bearing member.

48. An apparatus according to claims 38, 39, or 40, wherein said detecting means is disposed at a voltage application side of said charging member.

49. An image forming apparatus according to claim 38, wherein said apparatus further comprises a cleaning member for cleaning said charging member, and said cleaning member cleans said charging member before the detecting operation of said detecting means.

* * * * *

UNITED STATES PATENT AND TRADEMARK OFFICE

CERTIFICATE OF CORRECTION

PATENT NO. : 5,636,009

DATED : June 3, 1997

INVENTOR(S) : Takao Honda, et al.

It is certified that error appears in the above-identified patent and that said Letters Patent is hereby corrected as shown below:

COLUMN 4

Line 9, "end" should read --and--; and
Line 48, "RETAILED" should read --DETAILED--.

COLUMN 8

Line 55, "Pasoben's" should read --Paschen's--.

COLUMN 9

Line 55, "drum i" should read --drum 1--.

COLUMN 10

Line 62, "affecting" should read --effecting--.

COLUMN 11

Line 45, "Substantial" should read --substantial--.

COLUMN 17

Line 63, "bias" should read --DC--; and
Line 64, "DC" should read --bias--.

UNITED STATES PATENT AND TRADEMARK OFFICE

CERTIFICATE OF CORRECTION

PATENT NO. : 5,636,009

DATED : June 3, 1997

INVENTORS : Takao Honda, et al.

It is certified that error appears in the above-identified patent and that said Letters Patent is hereby corrected as shown below:

COLUMN 21

Line 28, "the" should be deleted; and
Line 56, "n" should read --in--.

COLUMN 22

Line 14, "18," should read --19,--.

COLUMN 24

Line 40, "claims 38 to 44, or 46," should read --claims 38 to 41, 44, or 46,--.

Signed and Sealed this

Seventeenth Day of February, 1998

Bruce Lehman

*Attest:*

BRUCE LEHMAN

*Attesting Officer*

*Commissioner of Patents and Trademarks*